US006895924B2

(12) United States Patent
Buswell et al.

(10) Patent No.: US 6,895,924 B2
(45) **Date of Patent: *May 24, 2005**

(54) INTAKE DEVICE FOR USE WITH INTERNAL COMBUSTION ENGINES

(75) Inventors: Mark L. Buswell, Prior Lake, MN (US); Craig L. Buswell, Hastings, MN (US)

(73) Assignee: CMB Enterprises, LLC, Prior Lake, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/633,766

(22) Filed: Aug. 4, 2003

(65) Prior Publication Data

US 2004/0020460 A1 Feb. 5, 2004

Related U.S. Application Data

(63) Continuation of application No. 09/753,468, filed on Jan. 3, 2001, now Pat. No. 6,601,562, which is a continuation of application No. 09/542,966, filed on Apr. 4, 2000, now Pat. No. 6,170,460, which is a continuation of application No. 09/115,113, filed on Jul. 13, 1998, now Pat. No. 6,073,609, which is a continuation-in-part of application No. 08/993,950, filed on Dec. 18, 1997, now abandoned.

(51) Int. Cl.[7] ..... F02M 29/14
(52) U.S. Cl. ..... 123/306; 123/590; 48/189.4
(58) Field of Search ..... 123/590–593, 123/306; 48/189.4, 189.5

(56) References Cited

U.S. PATENT DOCUMENTS

| | | | |
|---|---|---|---|
| 3,458,297 | A | 7/1969 | Anderson |
| 3,645,243 | A | 2/1972 | Ohlsson |
| 3,747,581 | A | 7/1973 | Kolb |

(Continued)

FOREIGN PATENT DOCUMENTS

| | | |
|---|---|---|
| FR | 728486 | 7/1932 |
| IT | 302410 | 10/1932 |
| IT | 600079 | 11/1959 |
| SU | 1326-755 | 7/1987 |
| WO | WO 81/02764 | 10/1981 |
| WO | WO 99/31377 | 6/1999 |

OTHER PUBLICATIONS

Advertisement, *Automotive Performance Wholesalers, Inc.*, p. 30 (Aug. 1997).
Advertisement, *Popular Hot Rodding,* p. 86 (Nov. 1997).
Advertisement, *Popular Hot Rodding, 37,* p. 112 (Sep. 1997).
McFarland, "More Torque on a Budget", *Popular Hot Rodding,* pp. 90, 92–93, 105 (Sep. 1997).
Product Literature, "BG Fuel Systems Oval Track Racing Products", Gold Claw® and Silver Claw®, http://www.bg-fuel.com/productline.com (Copyright 1998).
Product Literature, "Demon Carburetion" Barry Grant Inc., http://www.barrygrant.com/demon/default.aspx?page=4. Retrieved Jul. 30, 2003. 2 pages.

(Continued)

*Primary Examiner*—Erick Solis
(74) *Attorney, Agent, or Firm*—Mueting, Raasch & Gebhardt, P.A.

(57) ABSTRACT

A device for use in an intake path of an internal combustion engine may include a body portion, e.g., an insert body portion sized to be received within an opening defined in an intake path of an internal combustion engine, and at least one passage surface defining at least one passage about an axis through the body portion. The passage surface may define at least one channel. At least a portion of the passage surface may be tapered. Further, at least a portion of the passage surface may form at least a part of a venturi.

54 Claims, 16 Drawing Sheets

U.S. PATENT DOCUMENTS

| | | | |
|---|---|---|---|
| 3,826,235 | A | 7/1974 | Pasbrig |
| 3,848,665 | A | 11/1974 | Uerlichs et al. |
| 4,086,899 | A | 5/1978 | Gaylord |
| 4,092,966 | A | 6/1978 | Prosen |
| 4,094,290 | A | 6/1978 | Dismuke |
| 4,153,029 | A | 5/1979 | Ikegaya |
| 4,215,663 | A | 8/1980 | Gaylord |
| 4,711,225 | A | 12/1987 | Holderle et al. |
| 4,744,340 | A | 5/1988 | Kirby |
| 4,779,584 | A | 10/1988 | Mosler |
| 5,094,200 | A | 3/1992 | Fontichiaro |
| 5,099,808 | A | 3/1992 | Matsuura et al. |
| 5,392,752 | A | 2/1995 | Brogan et al. |
| 5,632,145 | A | 5/1997 | Hunt |
| 5,807,512 | A | 9/1998 | Grant |
| 5,863,470 | A | 1/1999 | Grant |
| 6,073,609 | A | 6/2000 | Buswell et al. |
| 6,120,007 | A | 9/2000 | Grant |
| 6,170,460 | B1 | 1/2001 | Buswell et al. |
| 6,286,817 | B1 | 9/2001 | Grant |
| 6,364,291 | B1 | 4/2002 | Grant |
| 6,595,175 | B1 | 7/2003 | Capoferi et al. |
| 6,601,562 | B2 | 8/2003 | Buswell et al. |

OTHER PUBLICATIONS

Product Literature, "PowerPlate" Powerdyne Automotive Products, Lancaster, CA. http://www.powerdyne.com, 4 pages (Copyright 2002) Retrieved Apr. 7, 2004.

Product Literature, "Turbonator" Turbonator.com Inc., http://www.turbonator.com/ Retrieved Feb. 19, 2004. 2 pages.

Product Literature "VR Velocity Stacks" VaraRam Industries http://www.vararam.com/ Retrieved Mar. 15, 2003. 4 pages.

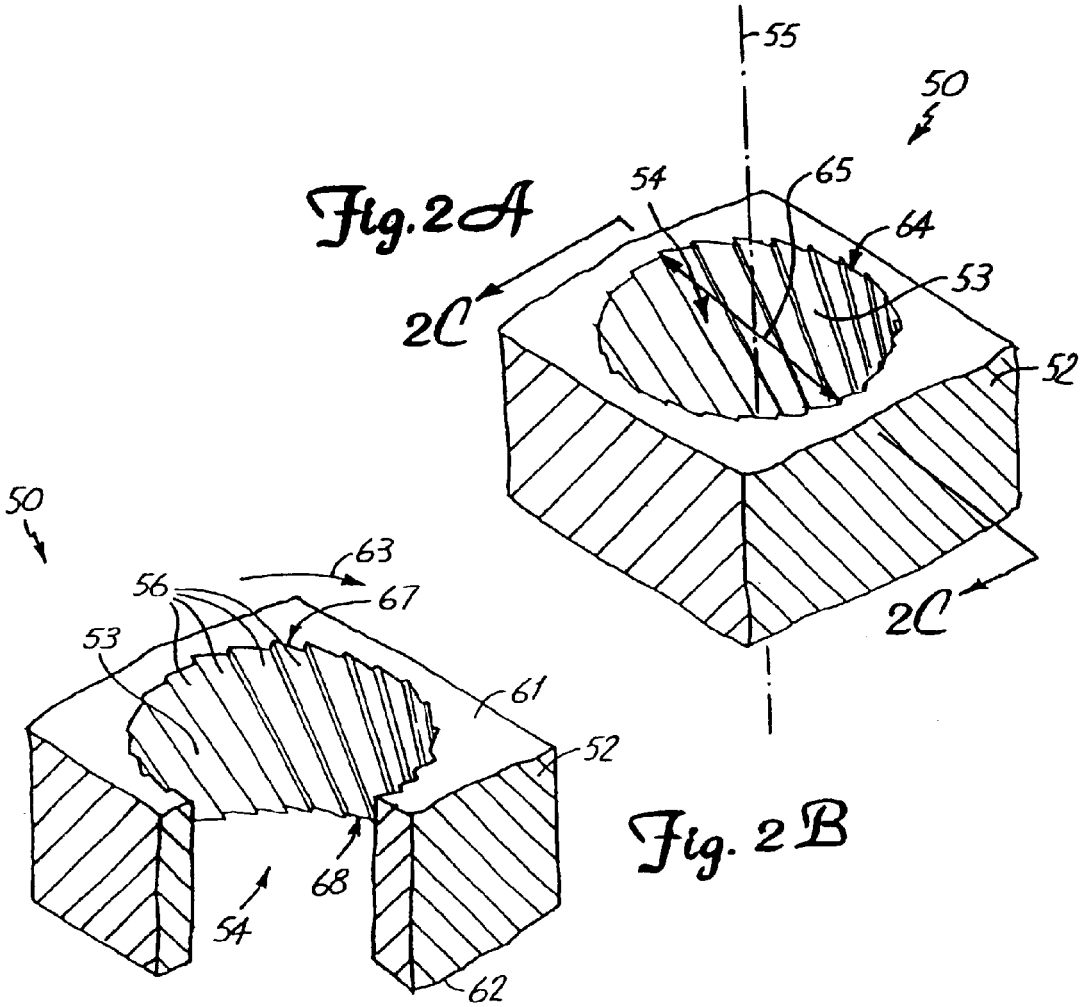
Fig. 2A
Fig. 2B
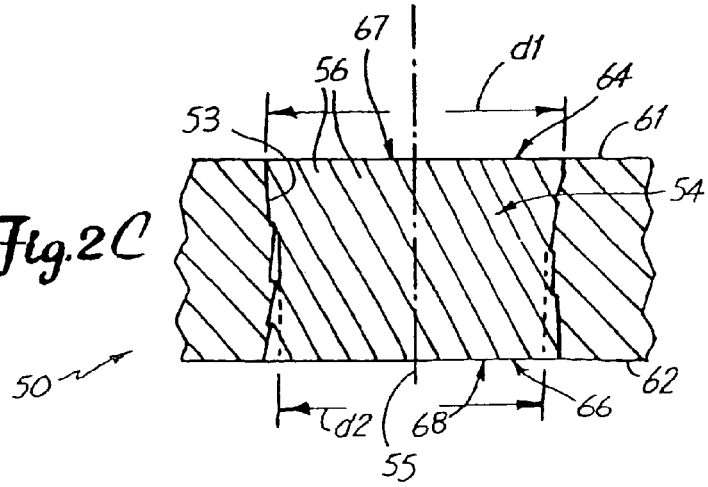
Fig. 2C

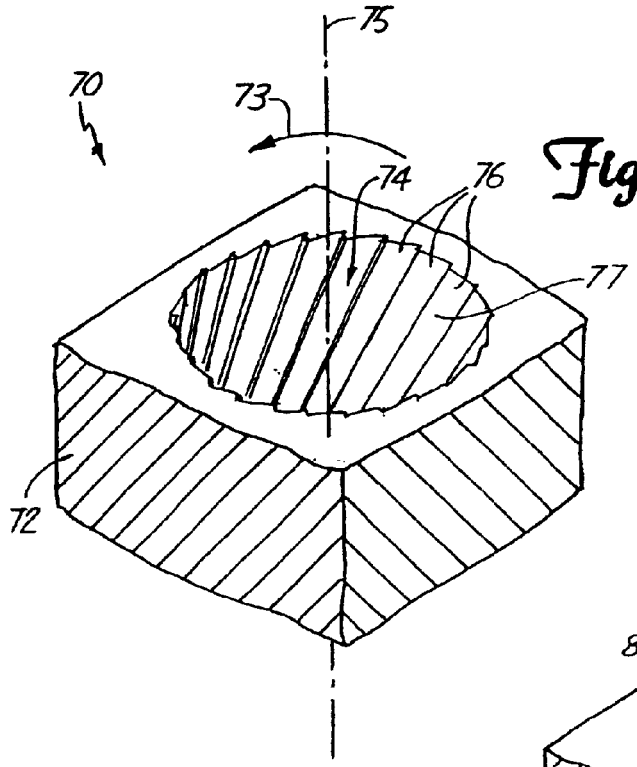
Fig. 3A
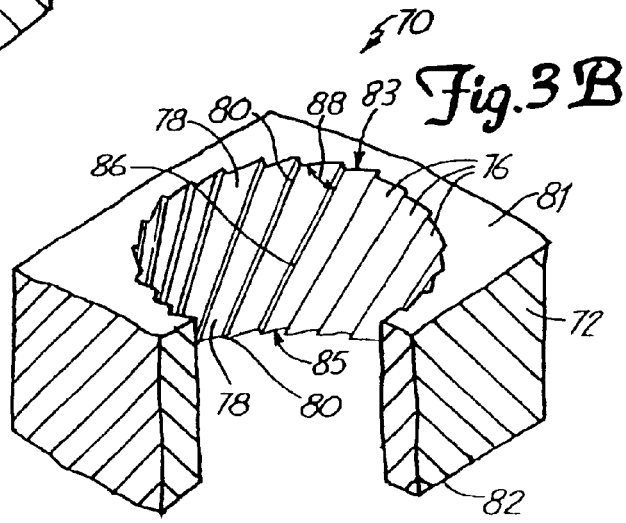
Fig. 3B
Fig. 3C
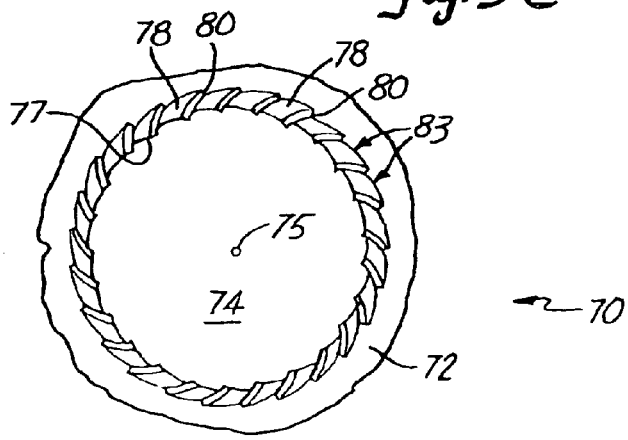

INTAKE DEVICE FOR USE WITH INTERNAL COMBUSTION ENGINES

CROSS REFERENCE TO RELATED APPLICATIONS

The present application is a continuation application of Ser. No. 09/753,468, filed on 3 Jan. 2001, now U.S. Pat. No. 6,601,562 which is a continuation application of Ser. No. 09/542,966, filed on 4 Apr. 2000, now U.S. Pat. No. 6,170,460 which is a continuation application of Ser. No. 09/115,113, filed on 13 Jul. 1998, now U.S. Pat. No. 6,073,609, which is a continuation-in-part of Ser. No. 08/993,950, filed on 18 Dec. 1997, abandoned, all of which are incorporated herein by reference.

FIELD OF THE INVENTION

The present invention relates to a device for use with internal combustion engines. More particularly, the present invention relates to devices for use in intake paths of internal combustion engines, e.g., spacers.

BACKGROUND OF THE INVENTION

Various devices for use in the intake path of internal combustion engines are available. Such devices are alleged to increase fuel economy, improve torque and pulling power of a vehicle, improve throttle response, improve fuel atomization resulting in greater combustion efficiency, etc.

Among such devices, by way of example, are in-line spacers. For example, various in-line devices are described in U.S. Pat. No. 4,086,899 entitled, "Air Fuel Inlet Device for Internal Combustion Engines," issued May 2, 1978; U.S. Pat. No. 4,215,663 entitled, "Air-Fuel Inlet Device for Internal Combustion Engines," issued Aug. 5, 1980; U.S. Pat. No. 4,711,225 entitled, "Connecting Piece Between the Carburetor and the Combustion Chamber of an Internal Combustion Engine," issued Dec. 8, 1987; and U.S. Pat. No. 3,645,243 entitled, "Fuel Mixing and Vaporizing Device for Internal Combustion Engines," issued Feb. 29, 1972.

One of such devices includes a spacer positioned between a base of the carburetor and the inlet of an intake manifold of an internal combustion engine. The spacer includes one or more passages therethrough for aligned communication between the carburetor outlet and the manifold inlet. A wall surface of each passage is formed with a number of spaced parallel annular recesses. Such recesses are parallel grooves disposed perpendicular to an axis of the passage. It is alleged that the spacer significantly increases engine efficiency, decreases fuel consumption, and decreases exhaust emissions.

The number and size of passages in spacers is generally determined by the number and the size of the outlets and inlets to be coupled in the intake path of the internal combustion engine. Such passages or bores through the spacer may be, for example, of a circular configuration to coincide with the size of a carburetor outlet or may be, for example, of a more rectangular or square configuration to provide one larger opening through the spacer between several carburetor outlets and intake manifold inlets.

Various other devices positionable between the carburetor and intake manifold of an internal combustion engine are used to intercept the air-fuel mixture. Generally, the devices operate on the air-fuel mixture such as by imparting an electrostatic charge to the mixture, by chopping the mixture to more finely divide the fuel particles and disperse a uniform air-fuel mixture uniformly to all the cylinders of the engine, and/or by manipulating the fuel-air mixture in some manner to change the flow of the mixture through the passage.

There is a continued desire to promote decreased fuel consumption of internal combustion engines, particularly with respect to automobile engines or other vehicle engines, e.g., engines of recreational vehicles. Such better gas mileage, i.e., decreased fuel consumption, along with a resulting decrease in exhaust emissions due to greater combustion efficiency are also required to meet environmental concerns. Further, sport vehicles, e.g., racing vehicles, towing vehicles, etc., are continually requiring engines which provide one or more of the following: more low end torque, more horsepower, better performance, etc.

Unfortunately, devices available have been unable to fulfill such functions. For example, many of the available devices have been found to yield little if any improvement in fuel economy or decrease in emissions.

SUMMARY OF THE INVENTION

The present invention, as described below, addresses the problems described above and other problems which will become apparent to one skilled in the art from the description below. Generally, the present invention provides a spacer having a particular passage configuration which improves engine performance, decreases fuel consumption (i.e., provides for better gas mileage), may result in more low-end torque, easier starting, more horsepower, and other various functions which will become apparent from the description below.

A device for use in an intake path of an internal combustion engine in accordance with the present invention includes a body portion having an upper surface and a lower surface. The body portion further includes at least one passage surface defining at least one passage about an axis from the upper surface to the lower surface. The passage surface further defines a plurality of channels about the axis of the passage. Each channel extends from a channel opening in the upper surface to a channel opening in the lower surface. At least a portion of each channel is at an angle relative to the axis of the passage.

In various embodiments of the device, one or more of the plurality of channels may be defined by a single channel surface with the surface having a curved portion of predetermined radius of curvature. Such a channel may be of a U-shaped configuration. One or more of the plurality of channels may also be defined by a first channel surface and a second channel surface with the first and second channel surfaces extending from the upper surface of the body portion to the lower surface of the body portion. Yet further, at least one of the first and second channel surfaces may be a substantially planar surface and/or at least one of the first and second channel surfaces may be a curved surface. Further, the plurality of channels may be defined by multiple channel surfaces such as in the formation of a substantially rectangular-type channel, e.g., square channel, or a substantially V-shaped channel.

In another embodiment of the device, the passage surface defining the passage is a continuous surface from the upper surface of the body portion to the lower surface of the body portion. The continuous surface extends from a first opening of the passage at the upper surface of the body portion inward towards the axis of the passage, and then further extends away from the axis of the passage towards a second opening of the passage at the lower surface of the body portion. In such a manner, the passage surface is of a venturi configuration.

In yet further embodiments of the device, the body portion includes at least two passage surfaces with each passage surface defining a passage about an axis from the upper surface of the body portion to the lower surface of the body portion. With at least two passages, each passage may have an axis which is parallel to an axis of another passage or have an axis which is at an angle relative to an axis of another passage. Further, the channels of one passage may be at an angle that is counter to an angle of the channels of another passage, e.g., clockwise and counterclockwise.

In yet a further embodiment of the device, the body portion defines a first opening of the passage at the upper surface of the body portion and a second opening of the passage at the lower surface of the body portion. The first and second openings are of a different size.

Another device for use in an intake path of an internal combustion engine according to the present invention includes a body portion having an upper surface and a lower surface. The body portion further includes at least one passage surface defining a passage about an axis from the upper surface to the lower surface. The passage surface defining the passage is a continuous surface from the upper surface of the body portion to the lower surface of the body portion. The continuous surface extends from a first opening of the passage at the upper surface of the body portion inward towards the axis of the passage, and then further extends away from the axis of the passage towards a second opening of the passage at the lower surface of the body portion.

In one embodiment of the device, the continuous surface is closest to the axis of the passage at a position substantially equidistant between the lower surface and the upper surface of the body portion.

In yet another embodiment of the device, the passage surface defines a plurality of channels about the axis of the passage with each channel extending from a channel opening in the upper surface to a channel opening in the lower surface. At least a portion of each channel is at an angle relative to the axis of the passage.

BRIEF DESCRIPTION OF THE DRAWINGS

FIGS. 2A–2C are a front perspective view, a cutaway front perspective view, and a cross-section view, respectively, of a portion of a spacer including a combination of the features shown in FIGS. 1A and 1B in a clockwise configuration; the cross-section view being taken at line 2C—2C of FIG. 2A.

FIGS. 3A–3C are a front perspective view, a cutaway front perspective view, and a top view of an alternate portion of a spacer showing a counterclockwise configuration of channels defined by a passage surface through the spacer portion.

DETAILED DESCRIPTION OF THE EMBODIMENTS

Figure 1B:
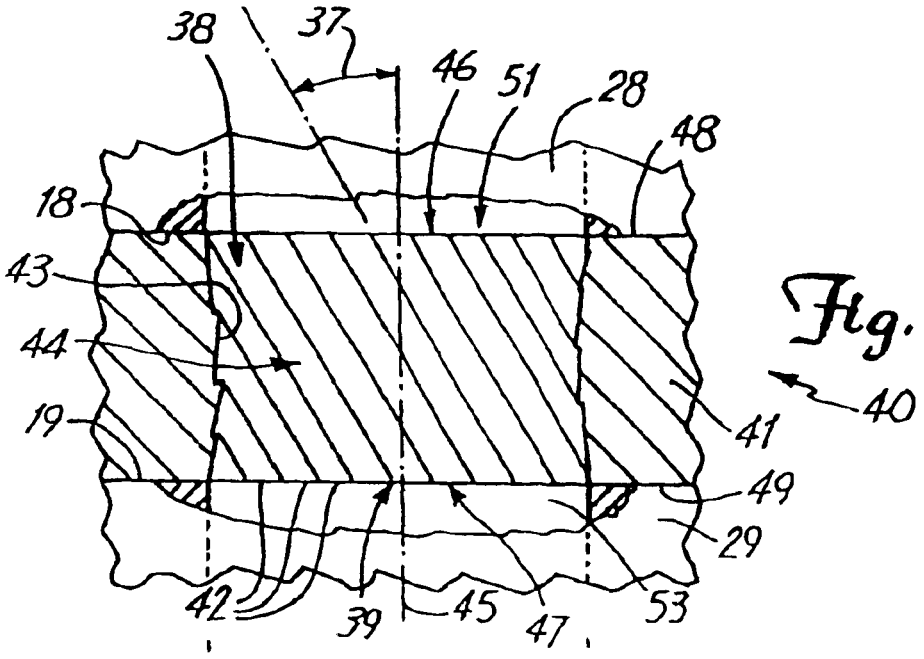
FIG. 1B is a cross-section view through the center of a passage defined in an alternate portion of a device positioned in an intake path of an internal combustion engine in accordance with the present invention including a passage surface defining channels.
Figure 1A:
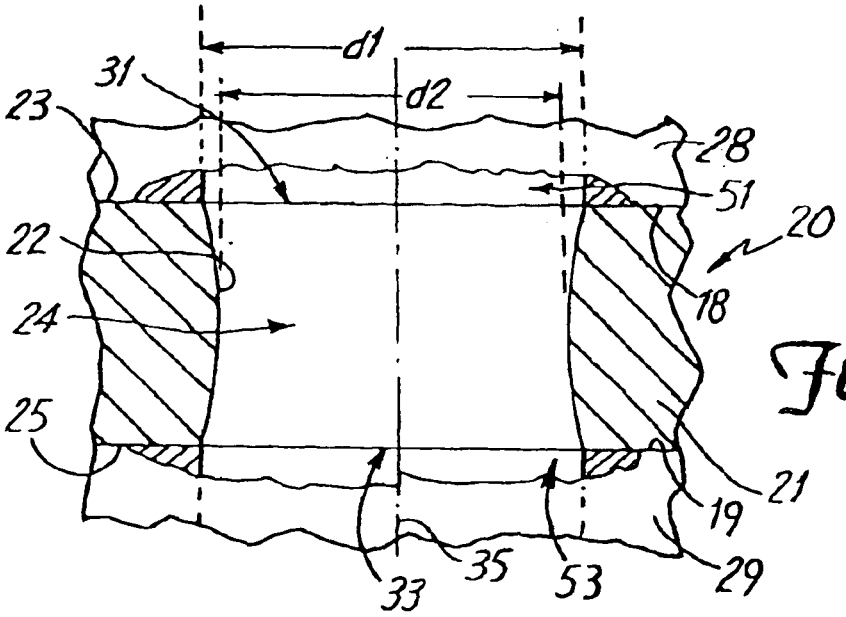
FIG. 1A is a cross-section view through the center of a passage defined in a portion of a device positioned in an intake path of an internal combustion engine in accordance with the present invention including a passage surface forming a venturi.

The present invention shall generally be described with reference to FIGS. 1A and 1B. Thereafter, various embodiments shall be described with further reference to FIGS. 2–13. Both of FIGS. 1A and 1B show a cross-section of a portion of a device 20, 40 positioned in an intake path of an internal combustion engine. The intake path of the internal combustion engine is shown generally in FIGS. 1A and 1B by first intake structure 28 and second intake structure 29. First intake structure 28, which is shown in cutaway view, includes an opening 51 and a surface 18. Second intake structure 29, also shown in cutaway view, includes an opening 53 and surface 19. The device portions 20, 40 are sized for alignment of opening 51, 53 of intake structures 28, 29 with passages 24, 44 defined in device portions 20, 40, respectively. The first intake structure 28 may be, for example, a carburetor of an internal combustion engine, and the intake structure 29 may be, for example, an intake manifold of an internal combustion engine. Such an illustrative example of the use of the present invention is further described with reference to FIG. 9, which shows in further detail a carburetor structure and manifold structure.

One skilled in the art will recognize that the device portions 20, 40 shown in FIGS. 1A and 1B may be part of any devices (e.g., spacers, adaptors, etc.) for use in any internal combustion engine. For example, such devices may be used with a carburetor or a throttle body in various applications, e.g., a car, a truck, a tractor, a motor home, a lawnmower, a chainsaw, a snowmobile, etc. Further, one skilled in the art will recognize that the device portions shown in FIGS. 1A and 1B, and the other alternate configurations described herein, apply to devices for use with four-barrel carburetors, two-barrel carburetors, single-barrel carburetors, throttle bodies, etc. Further, as will become apparent from the description below, the various embodiments and alternate configurations described herein may be used in one or more combinations, and the present invention is not restricted to any particular illustrative example shown in the drawings. For example, in a two-barrel carburetor, spacer passages as described with reference to FIGS. 2A–2C may be used in combination with spacer passages described with reference to FIGS. 3A–3C, i.e., clockwise configured channels may be utilized in the same spacer as counter-clockwise configured channels. It will further be understood to one skilled in the art that the teachings of the present invention are generally applicable to any air-fuel mixture supply system in the intake path of an internal combustion engine.

Generally, in accordance with the present invention, a device is provided with one or more bore holes or passages formed therethrough in positions to accommodate air-fuel mixture flow through first and second intake structures 28, 29, i.e., through openings 51, 53 thereof. As such, for example, a fuel-air mixture may proceed through opening 51 of first intake structure 28 through a bore hole or a passage 24, 44 formed through the device and exit the device into opening 53 of second intake structure 29. More specifically, with respect to a particular illustrative application, the air-fuel mixture flows through opening 51 of a carburetor into the bore hole or passage of a spacer and into an inlet opening 53 of an input manifold.

Generally, the bore hole or passage is defined in the form of a venturi. This increases the velocity of the air-fuel mixture flowing therethrough. Further, in addition to or in the alternative, the bore hole or passage may be defined to include a plurality of channels such that the air-fuel mixture is caused to swirl in the bore hole or passage of the device and/or in the space adjacent the outlet of the spacer to create a more complete mixture of fuel and air.

Utilizing either one or both of the venturi and the swirl configuration, the device results in better gas mileage, more low-end torque for vehicles, easier starting, and more horsepower. As indicated previously, such a device could be used with any internal combustion engine. One skilled in the art will recognize that although the device portions have been described between two structures of an intake path, e.g., carburetor and intake manifold, the invention contemplates and is intended to include by way of example integral formation of the device as an extension of either the first and second intake structures, e.g., the manifold inlet or the base of the carburetor, to define one or more passages structured and dimensioned in accordance with the present invention as described herein. For example, the present invention may be incorporated into carburetor bores, may be incorporated as an extension of the carburetor outlet (e.g., such that the extension extends into the manifold inlet), may be incorporated in a spacer or adaptor, or the channels and venturi may be incorporated into any opening in the intake path. Hereinafter, for simplicity purposes, the present invention shall be described with respect to spacers. However, one skilled in the art will recognize that the present invention may be used in various applications, devices and configurations in the intake path of any internal combustion engine, e.g., adaptor, extension of a carburetor bore, etc. and that the scope of the present invention is limited only according to the accompanying claims.

FIG. 1A is a cross-section view of a portion of a spacer 20 according to the present invention. The spacer portion 20 includes spacer body 21 having an upper surface 23 and a lower surface 25; such surfaces being substantially parallel to one another. The upper surface 23, when applied in an intake path of an internal combustion engine, is adjacent to surface 18 of first intake structure 28 and lower surface 25 is adjacent to surface 19 of second intake structure 29. Passage 24 includes an inlet opening 31 defined at the upper surface 23 of the spacer body 21 and an outlet opening 33 defined at the lower surface 25 of the spacer body 21. Generally, the size of the inlet opening 31 and outlet opening 33 may vary depending upon corresponding intake path structures 28, 29 and the openings 51, 53 defined therein.

The passage 24 defined in spacer body 21 is formed as a venturi, i.e., a structure including a constricted, throat-like passage that increases the velocity and lowers the pressure of a fluid conveyed through the passage. A passage surface 22 defines the passage 24 about an axis 35 from the upper surface 23 of the spacer body 21 to lower surface 25 of the spacer body 21. The passage surface 22 is a continuous surface from the upper surface 23 of the spacer body 21 to the lower surface 25 of the spacer body 21.

In FIG. 1A, the passage surface 22 is continuous in both the longitudinal direction along axis 35 and also about the inner circumference of passage 24. Continuous surface herein refers to a smooth surface not including steps, discontinuities, interference boundaries, or other structure that would interfere with the flow of a fluid along the surface. To form the venturi, the continuous passage surface 22 extends from inlet opening 31 at the upper surface 23 of spacer body 21 inward towards the axis 35 of the passage 24, and then further extends away from the axis 35 of the passage 24 towards outlet opening 33 of the passage 24 at the lower surface 25 of the spacer body 21. In other words, at one point along the passage surface 22 in the longitudinal direction, the surface is closer to axis 35 than at any other point along the longitudinal direction of passage surface 22. Preferably, the continuous passage surface 22 is closest to the axis 35 of passage 24 at a position substantially equidistant between the upper surface 23 of spacer body 21 and the lower surface 25 of spacer body 2 1.

Preferably, the diameter (d2) of the passage 24 at the point closest to axis 35 is in the range of about 0.7 to about 0.95 times the diameter (d1) of the passage 24 at one of either the inlet opening 31 or outlet opening 33, or both if d1 is the same for both openings 31, 33. Preferably, the diameter (d2) of the passage 24 at the point closest to axis 35 is about 0.8 to about 0.97 times the diameter (d1). Due to the formation of a venturi by passage surface 22, the velocity of an air-fuel mixture entering inlet opening 31 will be increased as the fuel-air mixture proceeds through passage 24 such that the velocity at outlet opening 33 is increased relative to the velocity of the mixture at inlet opening 31.

FIG. 1B is a cross-section view of an alternate device portion 40 having a passage 44 defined therethrough. Passage 44 extends from an inlet opening 46 at upper surface 48 of spacer body 41 to an outlet opening 47 at lower surface 49 of spacer body 41. The passage 44 is formed by passage surface 43 about axis 45.

The passage surface 43, as opposed to forming the passage 44 as a venturi through spacer body 41, defines a plurality of channels 42 about the axis 45 of the passage 44. Each channel 42 extends from a channel inlet opening 38 at upper surface 48 of spacer body 41 to a channel outlet opening 39 defined in the lower surface 49 of spacer body 41. At least a portion of each channel 42 is positioned at an angle 37 relative to the axis 45 of the passage 44. Preferably, the angle 37 of each channel 42 relative to the axis 45 is in the range of about 5 degrees to about 35 degrees, and more preferably is in the range of about 12 degrees to about 30 degrees.

With the channels 42 defined by channel surface 43 positioned at an angle relative to axis 45, air-fuel mixture entering inlet opening 46 is caused to swirl by the channels 42 in a clockwise direction. With the channels 42 being defined and extending from channel inlet openings 38 to channel outlet openings 39 at the lower surface 49 of spacer body 41, the air-fuel mixture is permitted to enter and exit without trapping the fuel-air mixture in the passage 44. Rather, the fuel-air mixture is mixed by the boundaries of the channels 42, e.g., a swirling or twisting effect. As a consequence, a substantially more uniform, homogenous mixture of fuel and air is provided to opening 53 of intake structure 29 than would result from conventional passages in spacers. The swirling effect is provided by the "twist" of the channels 42 defined by passage surface 43 through the spacer body 41. Any number of channels may be defined. Preferably, the number of channels is about 7 to about 30 Further, preferably, the channels are equally spaced about the axis of the passage.

FIGS. 2A–2C show an alternate spacer portion 50 in perspective view (FIG. 2A), in cutaway perspective view (FIG. 2B), and in cross-section view (FIG. 2C) taken at line 2C—2C of FIG. 2A. The spacer portion 50 includes a passage 54 defined as a venturi (in a similar manner as described with reference to FIG. 1A) and provides for a swirling effect or twist using defined channels 56 (in a similar manner as described with reference to FIG. 1B).

The spacer portion 50 includes the passage 54 defined through spacer body 52 by passage surface 53. The passage surface 53 defines channels 56 about the axis 55 of the passage 54. Each channel 56 extends from a channel opening 67 in an upper surface 61 of the spacer body 52 to a channel outlet opening 68 in lower surface 62 of spacer body 52 in a manner similar to that described with reference to FIG. 1B. Further, at least a portion of each channel 56 is at an angle relative to the axis 55 of the passage 54. The channels 56 create a clockwise swirl in passage 54, as generally shown by arrow 63. Likewise, the passage surface 53 includes a portion which is closer to axis 55 than other portions of the passage surface 53 in much the same manner as described with reference to FIG. 1A to configure the passage 54 as a venturi. With the venturi formed and the swirl effect created, the fuel and air mixture entering through opening 51 of first intake structure 28 is caused to swirl through passage 54 and increase in velocity for output into outlet opening 53 of second intake structure 29 when mounted in an intake path. In this preferred configuration, using both a venturi and channel configuration, the desirable results of better gas mileage, more low end torque, easier starting, and more horsepower and other engine performance benefits are superior relative to other conventional spacer configurations.

The passage surface 53 defining the passage 54 is a continuous surface from the upper surface 61 of spacer body 52 to the lower surface 62 of the spacer body 52. The continuous passage surface 53 extends from a first opening 64 of the passage 54 defined at the upper surface 61 of the spacer body 52 inward towards the axis 55 of the passage 54, and then further extends away from the axis 55 of the passage 54 towards a second opening 66 of the passage 54 defined at the lower surface 62 of the spacer body 52. In the same manner as described with reference to FIG. 1A, the continuous passage surface 53 is closest to the axis 55 of the passage 54 at a position substantially equidistant between the lower surface 62 and upper surface 61 of the spacer body 52. However, unlike the venturi defined and described with reference to FIG. 1A, the continuous passage surface 53 is continuous from the upper surface 61 of the spacer body 52 to the lower surface 62 of the spacer body 52, i.e., the surface 53 is continuous along channels 56. However, further, unlike the venturi described with reference to FIG. 1A, the passage surface 53 is not continuous about the inner circumference of passage 54, i.e., discrete steps exist along the inner circumference resulting from the definition of channels 56 by passage surface 53.

FIG. 3A illustrates a spacer portion 70 including a passage 74 defined through spacer body 72 by passage surface 77. The passage 74 extends from an opening at the upper surface 81 of spacer body 72 to an opening at the lower surface 82 of spacer body 72, as shown by the cutaway perspective view of FIG. 3B. The passage surface 77 defines a plurality of channels 76. Each channel 76 extends from a channel inlet opening 83 at the upper surface 81 to a channel outlet opening 85 at the lower surface 82 of spacer body 72. A top view of the spacer portion 70 is shown in FIG. 3C. The configuration of spacer portion 70 is substantially identical to the configuration of spacer portion 50 as described with reference to FIGS. 2A–2C. However, as opposed to having channels for creating a swirling effect in the clockwise direction (FIGS. 2A–2C, arrow 63), channels 76 are defined in a counter direction in the spacer portion 70. As such, and as represented by arrow 73, the swirling effect is provided in a counterclockwise direction.

In each of the illustrative embodiments shown in FIGS. 2A–2C and FIGS. 3A–3C, the channels 56, 76 are defined or configured substantially alike except for the angle of direction relative to the axis 55, 75 through the passage 54, 74. Therefore, such channels shall be described with reference to only FIGS. 3A–3C for simplicity purposes. Each channel 76 includes two channel surfaces, first channel surface 78 and second channel surface 80. The width of the first channel surface 78 is larger than the width of the second channel surface 80, i.e., the width being measured in a plane orthogonal to axis 75. Preferably, the width of the first channel surface 78 is in the range of about 1 to about 100 times the width of second channel surface 80. More preferably, the width of first channel surface 78 is in the range of about 1 to about 5 times the width of second channel surface 80. Further, first channel surface 78 and second channel surface 80 of each channel 76 have a shared edge 86. The angle 88 between first channel surface 78 and second channel surface 80 to the interior of edge 86 is in the range of about 20 degrees to about 120 degrees. More preferably, the angle 88 is in the range of about 70 degrees to about 100 degrees. The channels 76 are defined continuously about the entire inner circumference of passage 74, i.e., when one channel 76 ends, another channel 76 begins.

As shown in FIGS. 1–7, the channels extending from the upper surface of the spacer body to the lower surface of the spacer body for creating the clockwise or counterclockwise swirl within the passage defined through the spacer body may take one of many different configurations. In FIGS. 1B, 2A–2C, and 3A–3C, each channel is generally defined by two substantially planar surfaces positioned at an angle relative to each other, e.g., first and second planar surfaces 78 and 80 which form channels 76 as shown in FIG. 3B. As previously indicated, such surfaces may be of different widths, the angle between them may be varied, the angle of the channels may be varied, etc. However, the channels may be defined by any number, type and/or configuration of surfaces, i.e., other than two planar surfaces.

Generally, the channels may be formed by a single continuous surface, e.g., as shown and described with reference to FIGS. 4C and 4D, or may be formed with any other number of surfaces, e.g., as shown and described with reference to FIGS. 5A–5C. Further, such channels may be formed using surfaces that are not substantially planar, but rather where such surfaces have curvature associated therewith in either the longitudinal direction (direction of the axis of the passage), e.g., as shown and described with reference to FIGS. 7A and 7B, and/or where such surfaces have curvature associated therewith in the radial direction about the axis of the passage, e.g., as shown and described with reference to FIGS. 3D and 3E. Such curvature may have its center outside of the passage, e.g., surface 478 of FIG. 3E, or on the same side relative to the curved surface as the axis of the passage, e.g., surface 119 of FIG. 5C.

Figure 3D:
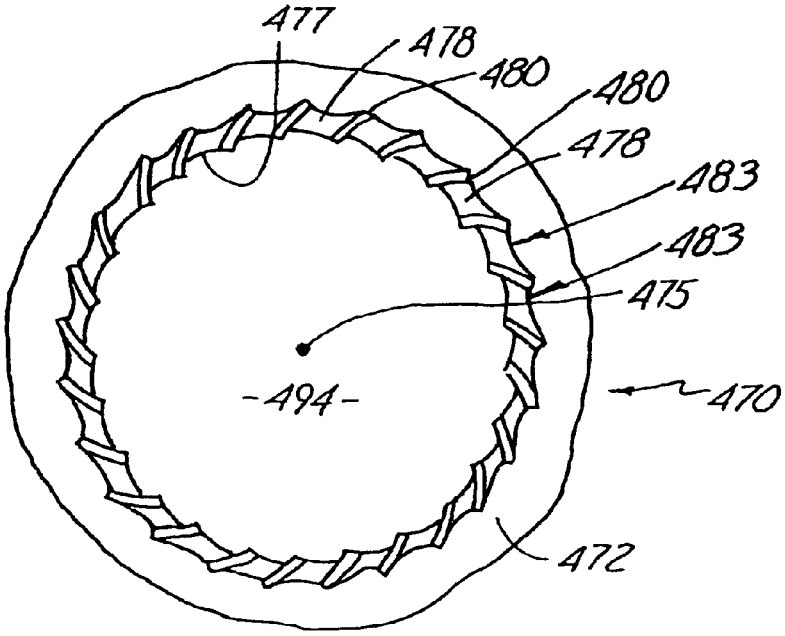
FIGS. 3D–3G show top views and cutaway perspective views, respectively, of alternate spacer portions including channels defined by at least one curved surface.
Figure 3E:
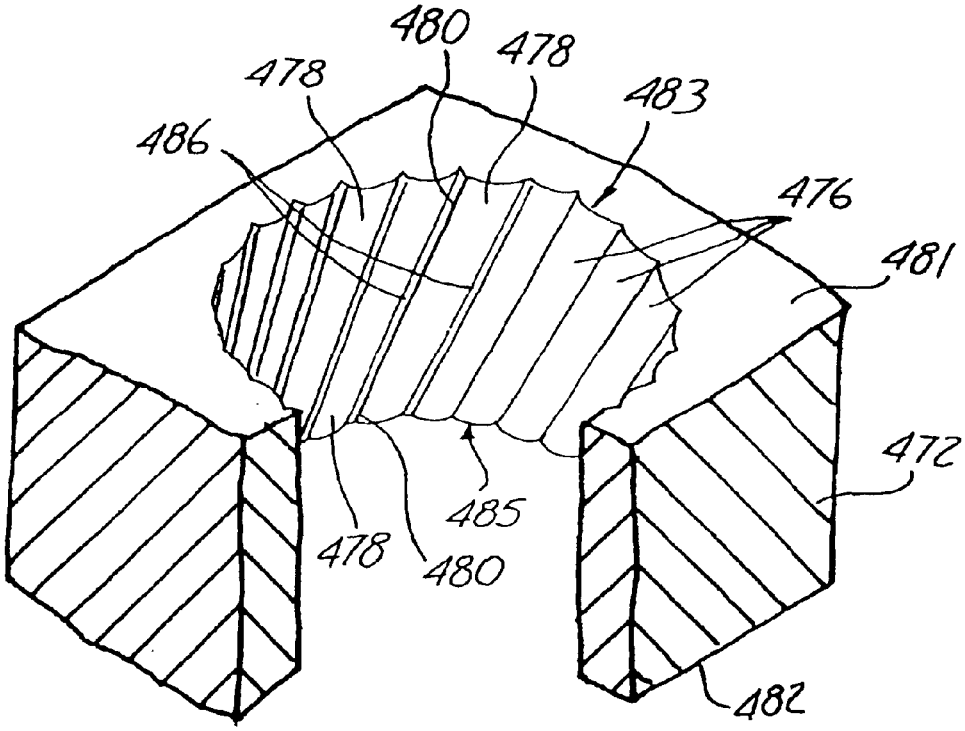

FIGS. 3D and 3E show a top view and a cutaway perspective view, respectively, of a spacer portion 470 including a passage 494 defined through the spacer body 472. Each of a plurality of channels 476 is defined by two channel surfaces, first channel surface 478 and second channel surface 480, extending from a channel inlet opening 483 at upper surface 481 to a channel outlet opening 485 at lower surface 482 of the spacer body. The width of the first channel surface 478 is larger than the width of the second channel surface 480, i.e., the width being measured in a plane orthogonal to axis 475. Further, first channel surface 478 and second channel surface 480 defining each channel 476 have a shared edge 486. The channels 476 are defined continuously about the entire inner circumference of passage 474, i.e., when one channel 476 ends, another channel 476 begins.

The second channel surface 480 is a generally planar surface such as described with reference to FIGS. 3A–3C. However, unlike the channel surfaces described with reference to FIGS. 3A–3C, the second channel surface 478 is a curved surface having a radius of curvature, wherein the center of the curvature is outside of the passage 494. By having a radius of curvature associated with the surface 478 as opposed to being a planar surface such as surface 480, a larger surface area is created for corresponding enhanced flow through the channel. Preferably, the radius of curvature is in the range of about 0.0625 inches to about 0.5 inches with the center of the curvature falling outside of the passage 494. More preferably, the radius of curvature is 0.2 inches with the center of the curvature falling outside of the passage 494.

One skilled in the art will recognize that such curvature may be used for any number of surfaces used to define the channels. For example, the surface 480 may have an associated radius of curvature with the center of the curvature being outside of the passage 494 or on the same side relative to the surface 480 as the axis 475, e.g., center in the passage, as described below with reference to FIGS. 3F and 3G. Further, various combinations of such surfaces may be used. Generally, any channel surface curvature defining the channels that would increase the surface area of the channels may be beneficial in accordance with the present invention.

Figure 3F:
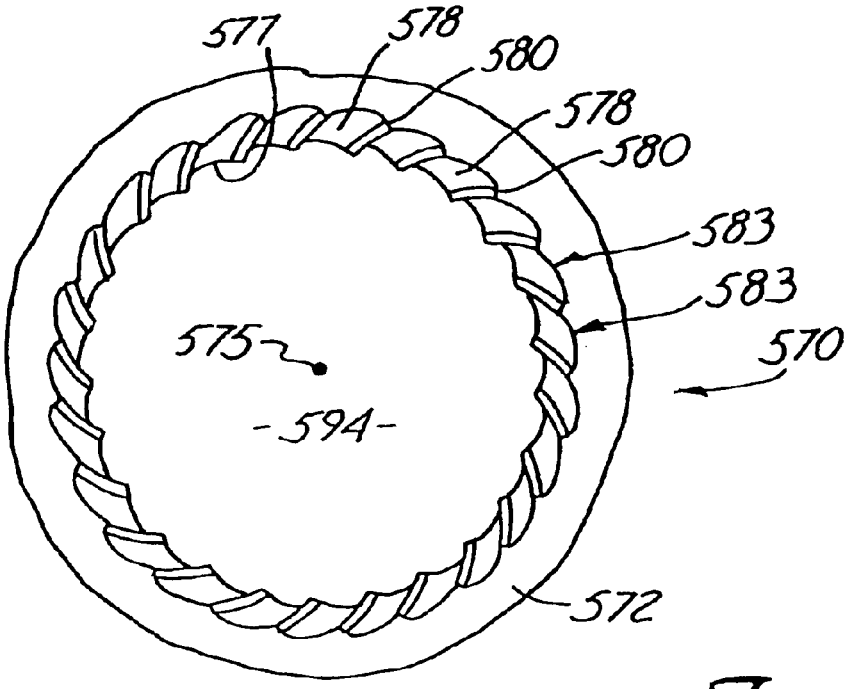
Figure 3G:
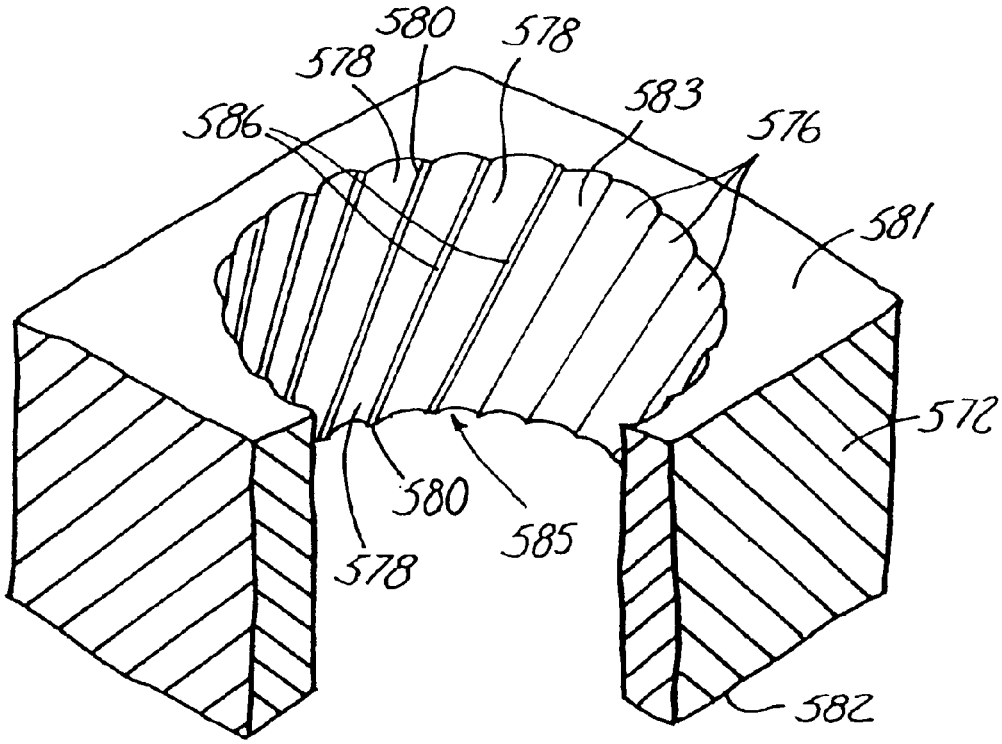

FIGS. 3F and 3G show a top view and a cutaway perspective view, respectively, of a spacer portion 570 including a passage 594 defined through the spacer body 572. Each of a plurality of channels 576 is defined by two channel surfaces, first channel surface 578 and second channel surface 580, extending from a channel inlet opening 583 at upper surface 581 to a channel outlet opening 585 at lower surface 582 of the spacer body. The width of the first channel surface 578 is larger than the width of the second channel surface 580, i.e., the width being measured in a plane orthogonal to axis 575. Further, first channel surface 578 and second channel surface 580 defining each channel 576 have a shared edge 586. The channels 576 are defined continuously about the entire inner circumference of passage 594, i.e., when one channel 576 ends, another channel 576 begins. As described herein with reference to other embodiments, any channel configuration may include channels continuously formed about the passage or discretely formed with surfaces separating such channels.

The second channel surface 580 is a generally planar surface such as described with reference to FIGS. 3A–3C. However, unlike the channel surfaces described with reference to FIGS. 3A–3C, the second channel surface 578 is a curved surface having a radius of curvature, wherein the center of the curvature is on the same side relative to the surface as the axis 575, e.g., the center may be inside the passage 594. As described previously with reference to FIGS. 3D and 3E, by having a radius of curvature associated with the surface 578 as opposed to being a planar surface such as surface 580, a larger surface area is created for corresponding enhanced flow through the channel. Preferably, the radius of curvature is in the range of about 0.0625 inches to about 0.5 inches with the center of the curvature falling on the same side of the surface 580 as the axis 575 of the passage 594. More preferably, the radius of curvature is 0.2 inches with the center of the curvature falling on the same side of the surface 580 as the axis 575 of the passage 594.

Figure 4A:
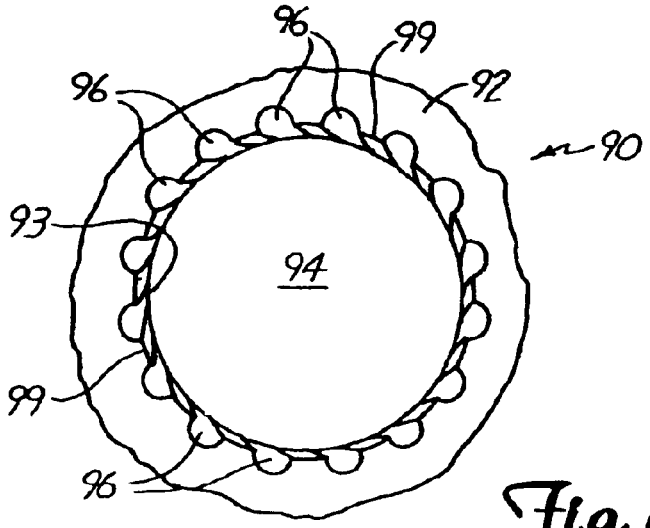
FIGS. 4A and 4B show a top view and a cutaway perspective view, respectively, of an alternate spacer portion including discretely separated U-shaped channels.
Figure 4B:
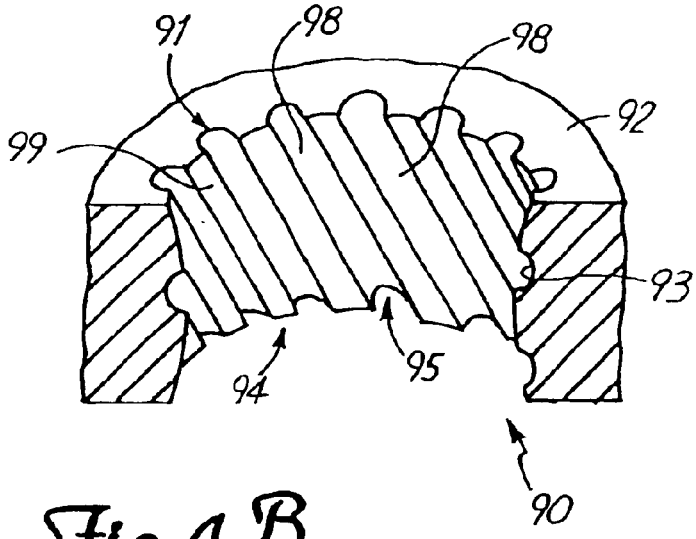

FIGS. 4A and 4B show a top view and a cutaway perspective view, respectively, of a spacer portion 90 including a passage 94 defined through the spacer body 92. Each of a plurality of channels 96 is defined by a single channel surface of passage surface 93 extending from a channel inlet opening 91 to a channel outlet opening 95. Each single surface channel 96 includes a curved portion with a predetermined radius of curvature. Preferably, the radius of curvature is about 0.016 inches to about 1 inch. More preferably, the radius of curvature is about 0.0625 inches to about 0.25 inches. As such, U-shaped channels 96 are defined between substantially flat portions 99 of passage surface 93.

Figure 4C:
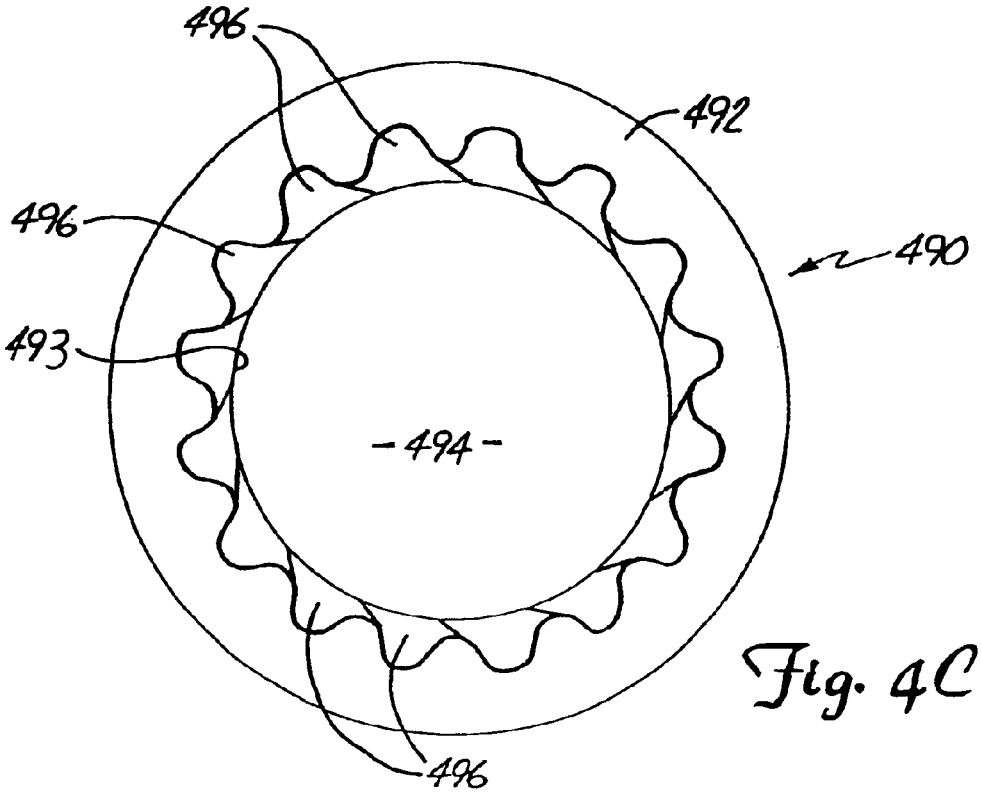
FIGS. 4C and 4D show a top view and a cutaway perspective view, respectively, of an alternate spacer portion including continuously occurring U-shaped channels.
Figure 4D:
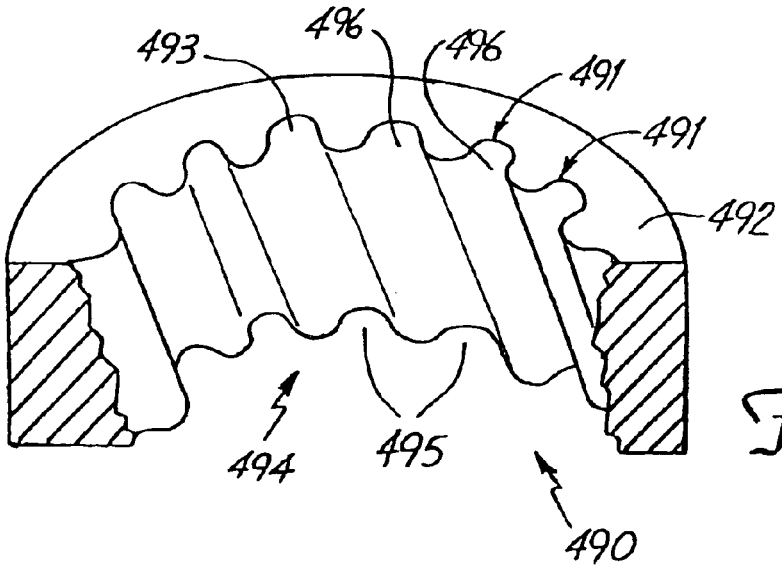

FIGS. 4C and 4D show a top view and a cutaway perspective view, respectively, of a spacer portion 490 including a passage 494 defined through the spacer body 492. All of the plurality of channels 496 are defined by a single curved passage surface 493 and extend from channel inlet openings 491 to channel outlet openings 495. The channels preferably have the same radius of curvature as described above with reference to FIGS. 4A and 4B. Because the channels are formed with a continuous curved passage surface 493, unlike the surfaces of FIGS. 4A and 4B, the U-shaped channels 496 are defined continuously about the axis of the passage, as opposed to discretely with other portions therebetween, e.g., such as substantially flat portions 99 of FIGS. 4A and 4B.

Figure 5A:
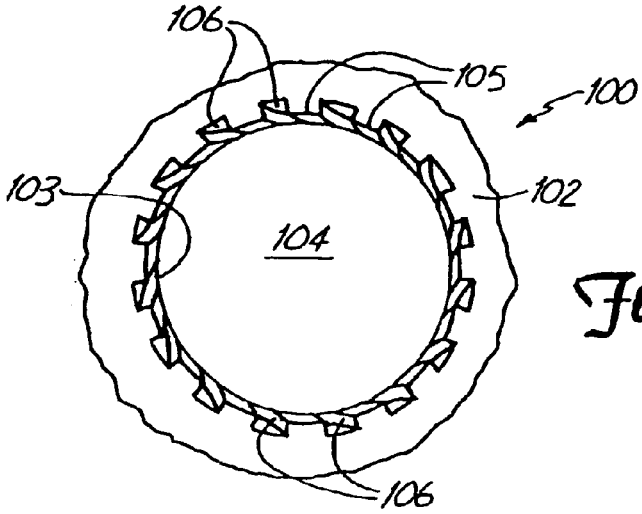
FIGS. 5A and 5B show a top view and a cutaway perspective view, respectively, of another alternate spacer portion including rectangular-shaped channels.
Figure 5B:
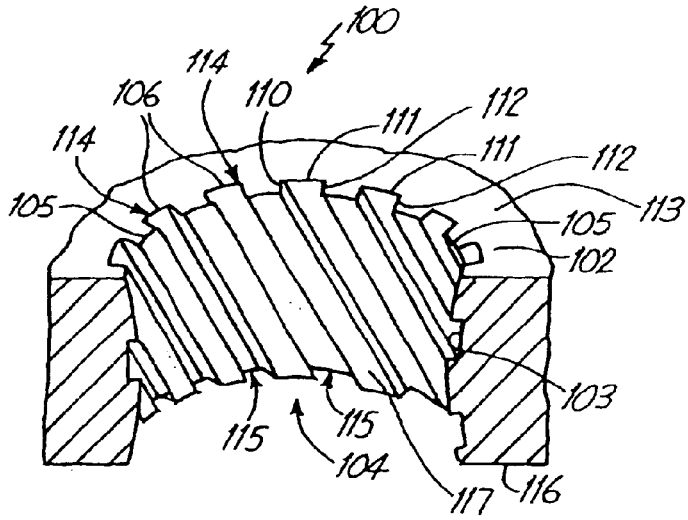

In the top view of FIG. 5A and the cutaway perspective view of FIG. 5B, a spacer portion 100 having a passage 104 defined through a spacer body 102 by passage surface 103 is shown. A plurality of channels 106 are defined by passage surface 103. The passage surface 103 includes a first channel surface 110, second channel surface 111, and third channel surface 112 for defining each channel 106 of a substantially rectangular-shape, e.g., a square-shape channel when the width of the three channel surfaces are all approximately equal. Each channel 106 is discretely separated from another channel by surfaces 105 and extends from channel inlet opening 114 defined in upper surface 113 of spacer body 102 to a channel outlet opening 115 defined in lower surface 116 of spacer body 102.

Figure 5C:
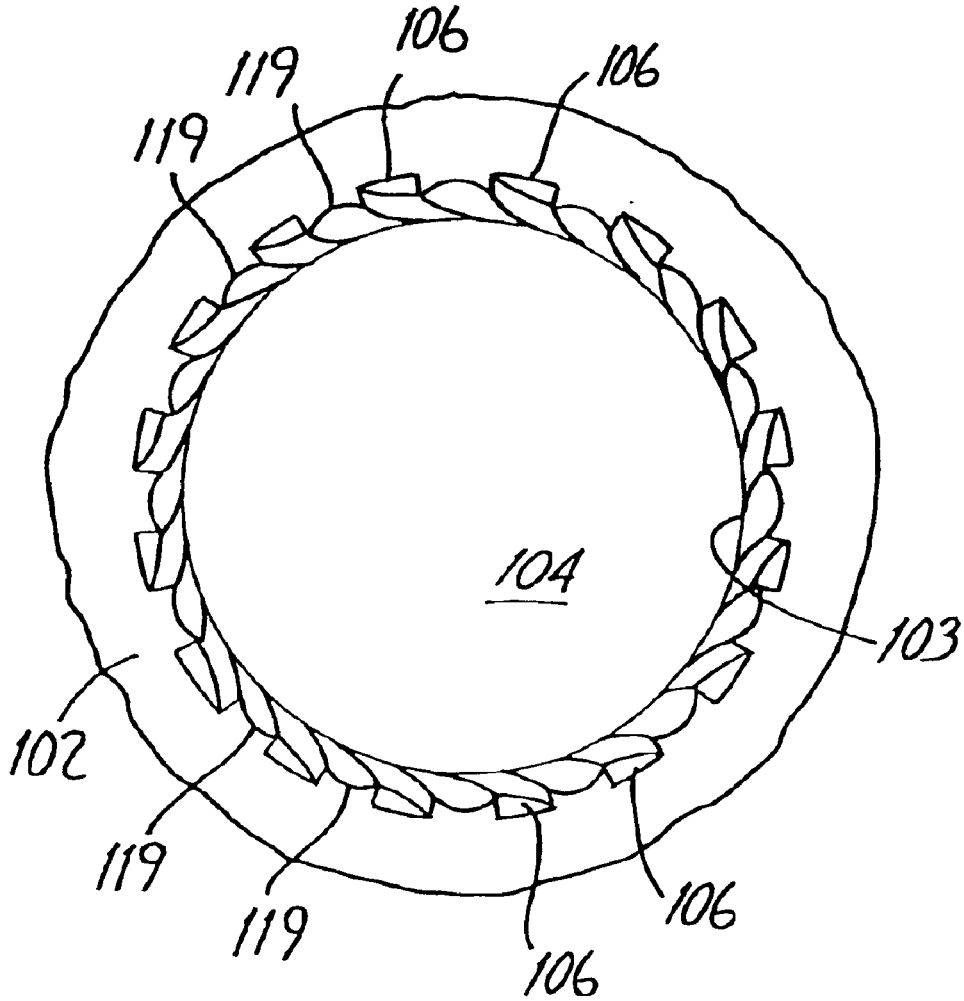
FIG. 5C shows a top view of an alternate spacer portion including rectangular-shaped channels separated by curved surfaces.

The top view of a spacer portion shown in FIG. 5C is substantially the same as the configuration of FIGS. 5A and 5B. However, in the configuration of FIG. 5C, the surfaces 105 as shown in FIGS. 5A and 5B are replaced with curved surfaces 119. The curvature extends outwardly away from the axis of the passage 104.

Figure 6A:
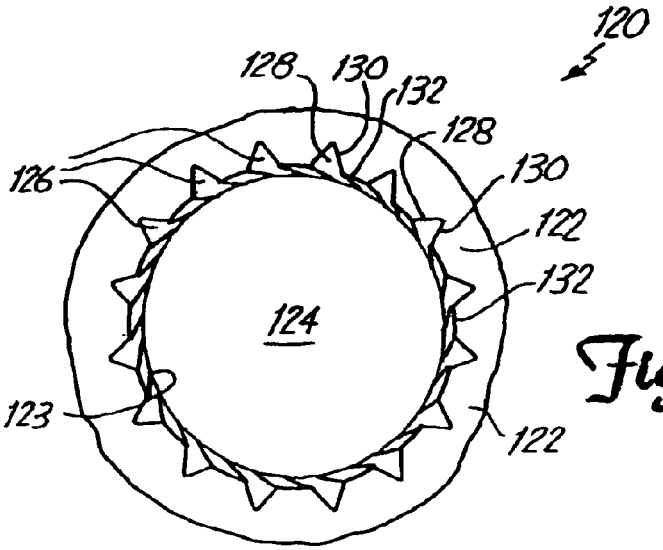
FIGS. 6A and 6B show a top view and a cutaway perspective view, respectively, of yet another alternate spacer portion including discretely separated V-shaped channels.
Figure 6B:
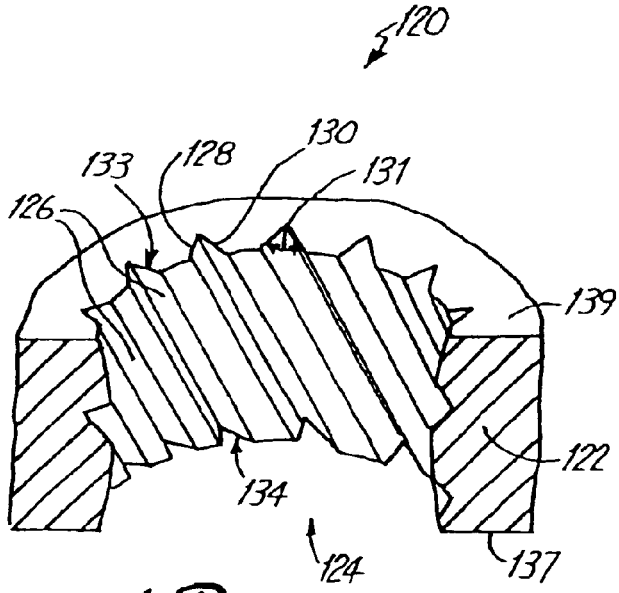

For example, as shown in FIGS. 6A and 6B, spacer portion 120 includes a passage 124 defined by passage surface 123 through spacer body 122. Channels 126 are defined by two channel surfaces, first channel surface 128 and second channel surface 130. The channels 126 are separated by a surface 132. The first channel surface 128 and second channel surface 130 form a substantially V-shaped channel. The width of each channel surface 128, 130 is substantially equal. An angle 131 between the channel surfaces 128, 130 is in the range of about 10 degrees to about 120 degrees. More preferably, the angle 131 is in the range of about 30 degrees to about 60 degrees. Each channel 126 extends from a channel inlet opening 133 defined in an upper surface 139 of spacer body 122 to a channel outlet opening 134 defined in a lower surface 137 of spacer body 122.

Figure 6C:
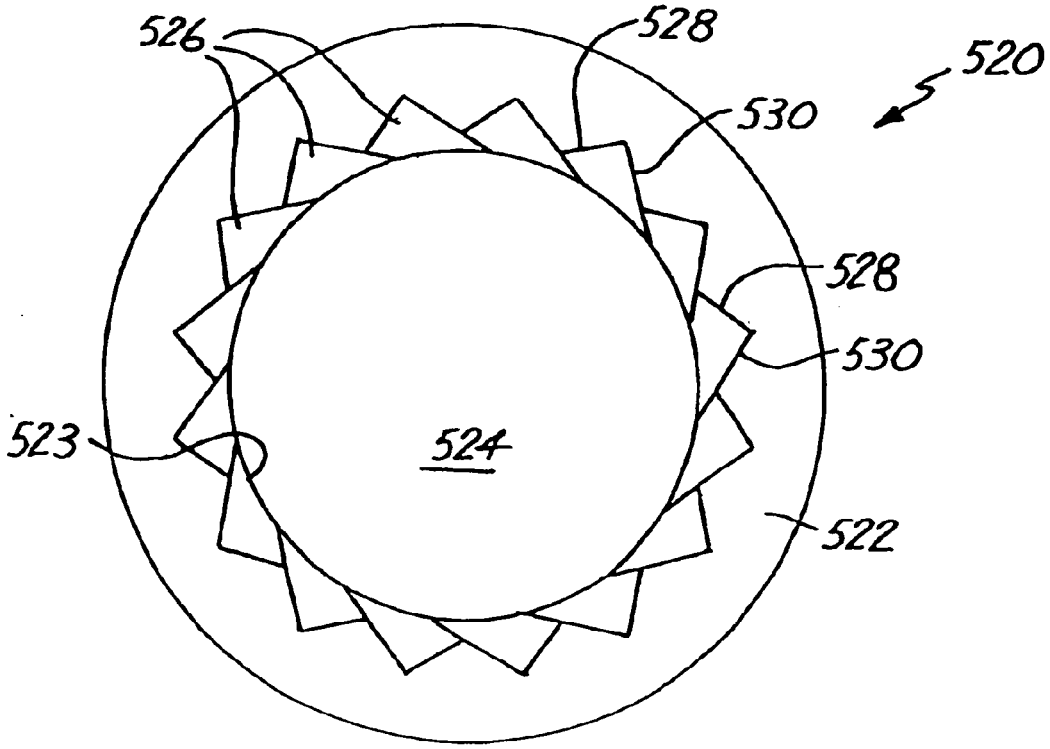
FIGS. 6C and 6D show a top view and a cutaway perspective view, respectively, of yet another alternate spacer portion including continuously occurring V-shaped channels.
Figure 6D:
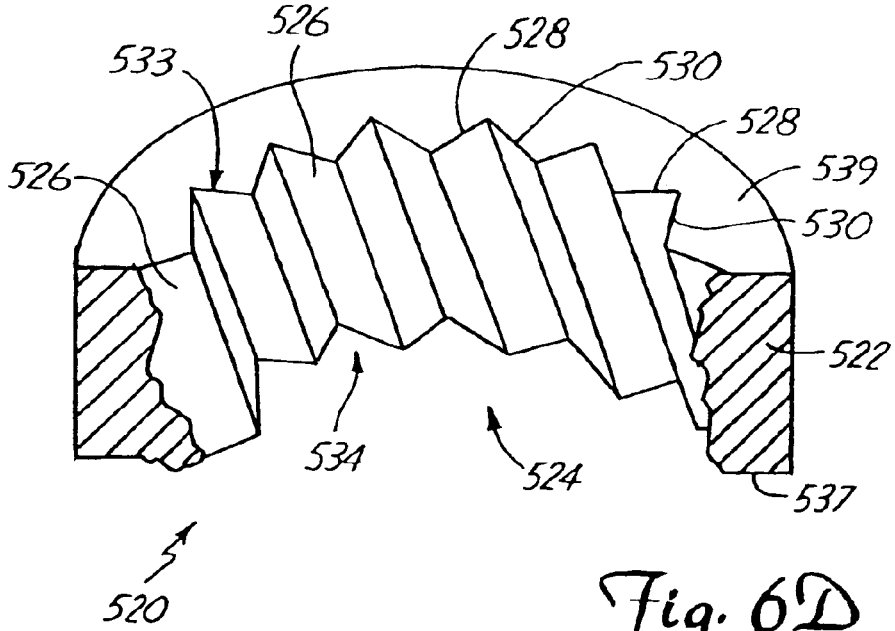

FIGS. 6C and 6D show a top view and a cutaway perspective view, respectively, of a spacer portion 520 including a passage 524 defined through the spacer body 522. Channels 526 are defined by two channel surfaces, first channel surface 528 and second channel surface 530. The first channel surface 528 and second channel surface 530 form a substantially V-shaped channel. The width of each channel surface 528, 530 is substantially equal, although any widths may be used. The angle between the channel surfaces is in the ranges as described above with reference to FIGS. 6A and 6B. Each channel 526 extends from a channel inlet opening 533 defined in an upper surface 539 of spacer body 522 to a channel outlet opening 534 defined in a lower surface 537 of spacer body 522. The channels 526 are formed continuously radially about the axis of the passage 524, unlike the discretely separated channels of FIGS. 6A and 6B.

One skilled in the art will recognize that each channel may be defined by any number of channel surfaces, e.g. planar or curved, as long as each of the channel surfaces extends from the upper surface of the spacer body to the lower surface of the spacer body. In such a manner, the surfaces form a continuous channel with no discrete elements or steps therein in the longitudinal direction, i.e., the direction of the axis of the passage.

The spacer body of the various configurations described herein may be of any material capable of withstanding the temperature constraints within the intake path. Although the spacer may be formed of steel, aluminum, wood, or any other suitable material, the spacer is preferably formed of a high temperature resistant material such as a thermosetting polymer to prevent heat transfer from one portion of the intake path to another.

The spacer configurations described herein may be of monolithic structure with the passage configurations machined therein. However, the spacer configurations may also be comprised of any number of components or elements to form the particular structure as described herein. The spacers formed using one or more of the illustrative configurations described herein are preferably machined in a monolithic structure using known machining devices, such as computerized numerical control (CNC) machines or electrical discharge machines (EDMs).

The size of the passage and the thickness of the spacers will depend upon the application and the desired results. For example, the diameter of the passage required to obtain the maximum mileage per gallon may be different than that necessary to provide maximum horsepower. More particularly, for example, when the spacer is used in a configuration such as described below with reference to FIGS. 9 and 10, i.e., positioned between a carburetor and manifold, the diameter of the passage through the spacer body is matched to the diameter of the carburetor outlet. Specifically, for example (as shown in FIG. 2A), preferably the diameter 65 measured between the inner most locations, i.e., closest to axis 55, of the channel surfaces defining channels 56 at the opening 64 is the same as the diameter of the outlet or bore of the carburetor.

Further, for example, the spacer thickness may be of any thickness suitable to obtain desired results; preferably in a range of about ½ inch to about 3 inches. For example, the spacer thickness may be standard spacer thicknesses, such as 1 inch, 1½ inches, 2 inches, 3 inches.

Figure 7A:
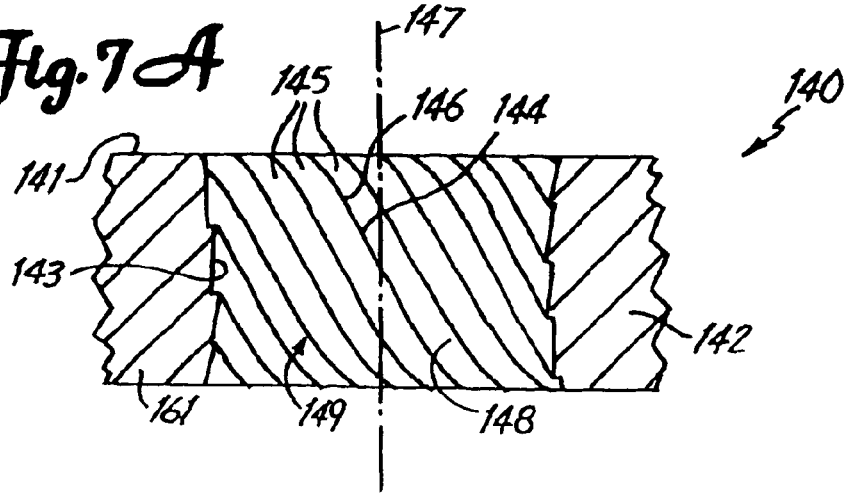
FIGS. 7A and 7B show additional alternate configurations of channels defined in spacer portions; the channels including various curvatures associated therewith.
Figure 7B:
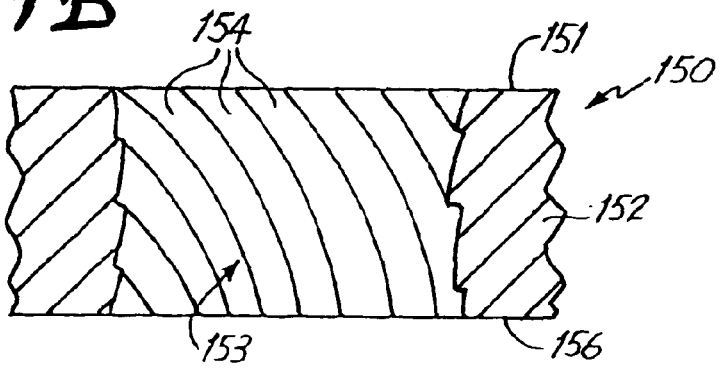

FIGS. 7A and 7B show channel configurations wherein the channels have various associated curvature therewith. For example, as shown in FIG. 7A, spacer portion 140 includes a passage 149 defined through spacer body 142 by passage surface 143. Channels 145 defined by passage surface 143 extend from the upper surface 141 of the spacer body 142 to the lower surface 161 of the spacer body 142. However, unlike previous embodiments described herein, each channel 145 includes a channel portion 144 which is substantially straight and at an angle relative to axis 147 and also includes a portion 146 which is of a curved shape adjacent upper surface 141 of spacer body 142 and a further curved portion 148 adjacent the lower surface 161 of spacer body 142.

As shown in FIG. 7B, a spacer portion 150 having a passage 153 defined through spacer body 152 includes channels 154 which are formed of a single curved nature from the upper surface 151 of spacer body 152 to the lower surface 156 of spacer body 152.

Figure 8:
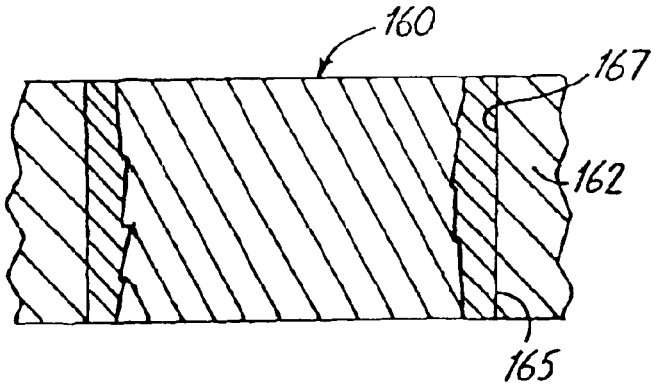
FIG. 8 is a cross-section view through an alternate spacer configuration showing an insert including a passage defined therethrough for insertion or positioning in another intake device.

FIG. 8 illustrates the use of an insert 160 having an outer surface 165 sized for positioning adjacent surface 167 defining an opening within another device body, e.g., a spacer, adaptor, carburetor bore, manifold inlet, or any other opening in the intake path of an internal combustion engine. The insert 160 includes a passage configuration substantially equivalent to that described with reference to FIGS. 2A–2C.

Figure 9:
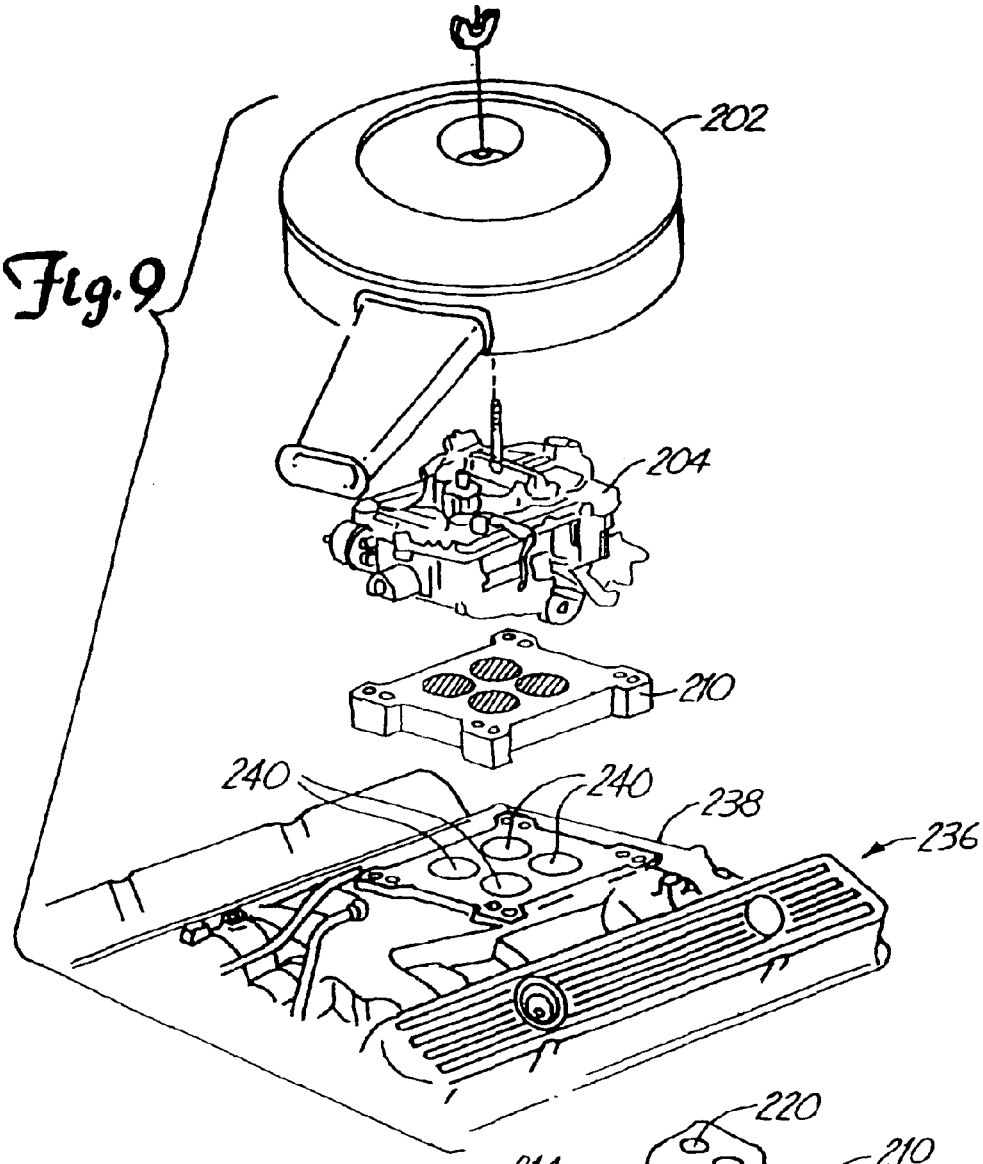
FIG. 9 is an exploded perspective view showing the manner in which a spacer according to the present invention is positioned between the carburetor and the intake manifold of an internal combustion engine having a four-barrel carburetor.
Figure 10A:
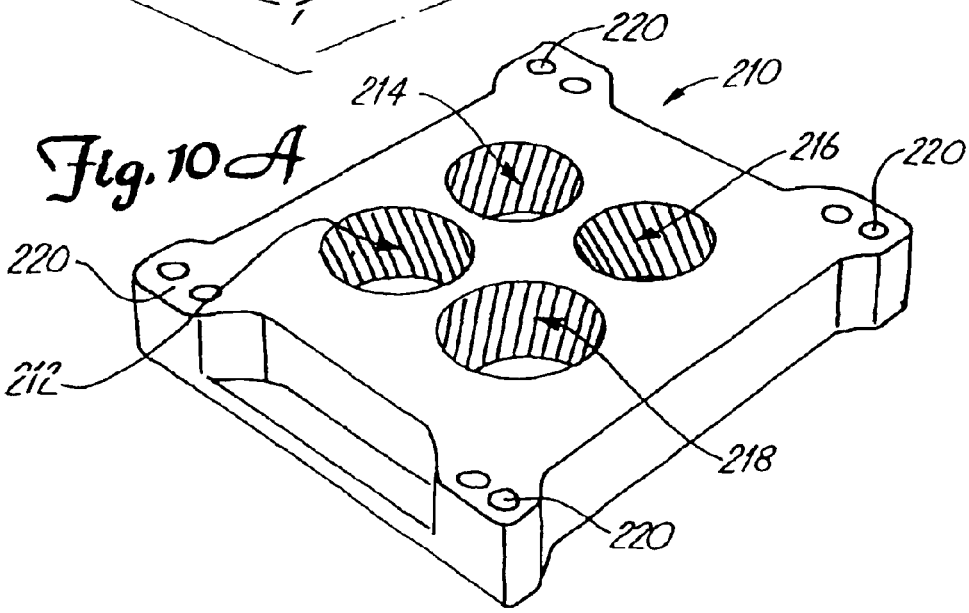
FIG. 10A is a more detailed perspective view of the spacer of FIG. 9.

Referring to FIGS. 9 and 10, a spacer 210 including one or more of the spacer portion configurations as described herein is shown positioned between a carburetor 204 and an intake manifold 238 of an internal combustion engine 236. The carburetor barrels extend from inlets at the upper end of the carburetor to outlets in a base of the carburetor, and, in the absence of the spacer 210, the outlets communicate directly with inlets 240 in the manifold 238 to provide an air-fuel mixture to the manifold 238. The configuration of the spacer 210 conforms generally with the base of a carburetor 204 and the inlet area or surface of the manifold 238. When positioned between the base of the carburetor 204 and the inlet surface of the manifold 238, the passages 212, 214, 216, 218 defined in spacer 210 align axially with the carburetor outlets and corresponding inlets of 240. A plurality of holes 220 are defined through the spacer 210 and positioned to accommodate the carburetor 204 and/or manifold 238 to mounting bolts whereby the spacer is properly aligned with the carburetor 204 and manifold 238. As is customary, an air filter 202 filters the air drawn into the carburetor 204.

Figure 10B:
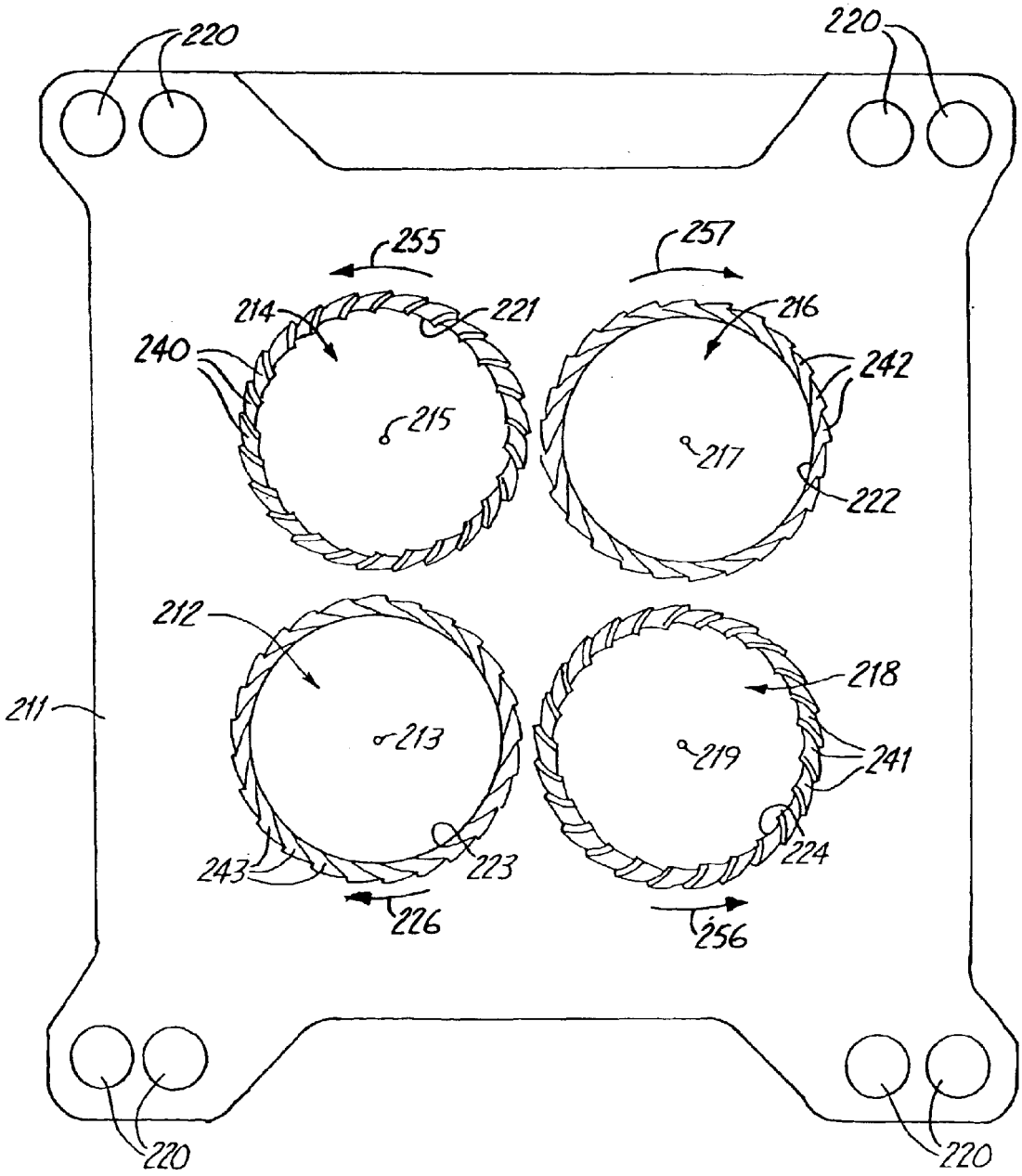
FIG. 10B is a more detailed top view of the spacer of FIG. 10A.

As shown in FIG. 10B, passage 214 defined about axis 215 by passage surface 221 include channels 240 for creating a counterclockwise swirl as represented by arrow 255. Passage surface 224 defining passage 218 about axis 219 also defines channels 241 for creating a counterclockwise swirl as represented by arrow 256. On the other hand, passage surfaces 222, 223 define passages 216, 212 about axes 217, 213, respectively. The passage surfaces 222, 223 further define channels 242, 243 for providing a clockwise swirl or twist through passages 216, 212, as represented by arrows 257, 226, respectively.

One skilled in the art will recognize that the clockwise or counterclockwise nature of the channels provided in a four-barrel configuration may take one of sixteen different combinations. Likewise, in spacers which have only two passages, combinations of clockwise and counterclockwise passages may be one of any four different combinations.

Figure 11:
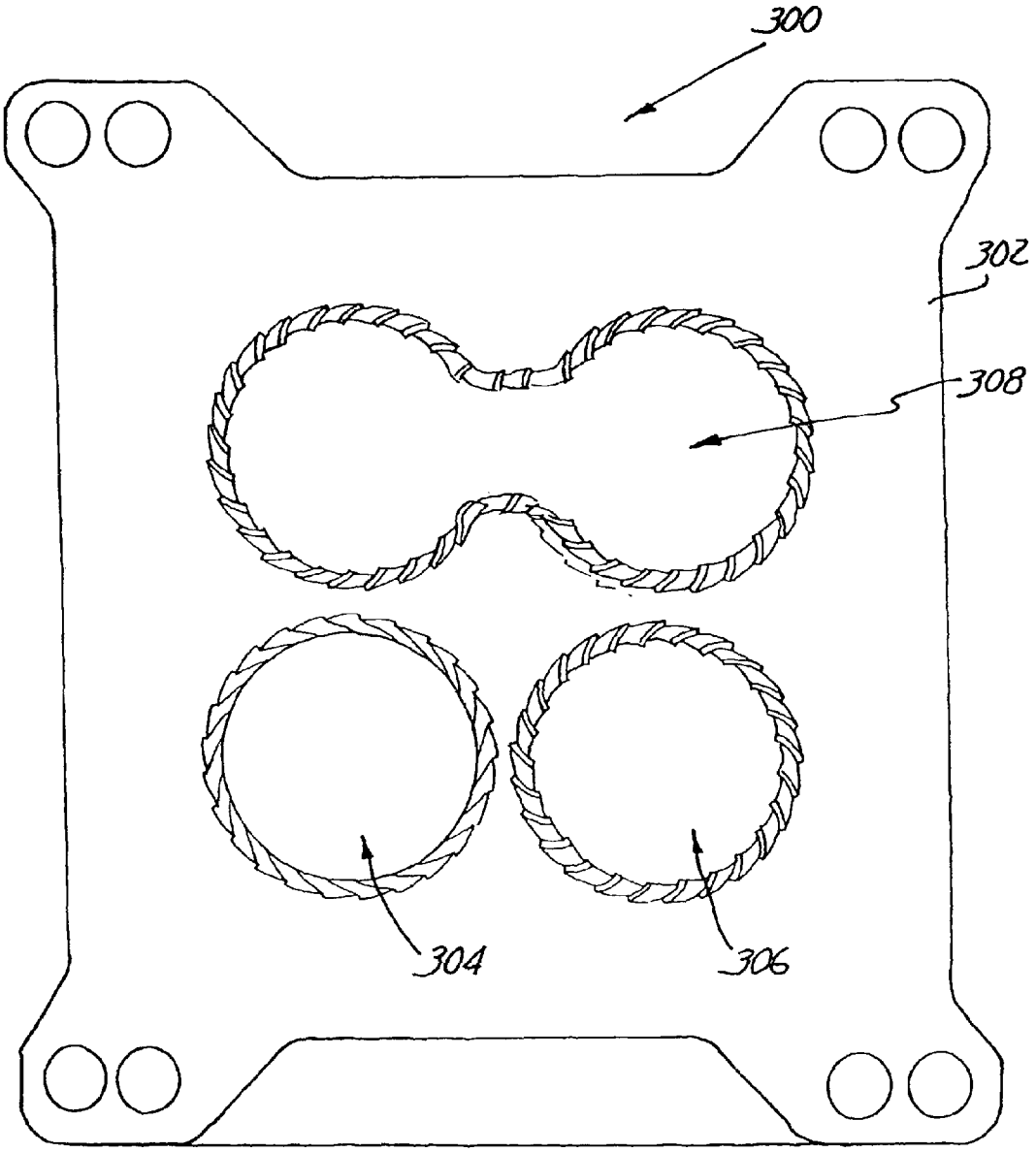
FIG. 11 is a top view of an alternate spacer for use in the intake path of FIG. 9.

Further, as shown in FIG. 11, a spacer 300 for a four-barrel configuration may include a spacer body 302 having two separate passages for alignment with the front barrels of an internal combustion engine, as shown by passages 304 and 306. The rear two barrels of the engine may share a common passage 308 defined in spacer body 302. Note that channels may be defined by channel surfaces about the inner perimeter of any shaped opening, e.g., opening 308, as opposed to only cylindrical type openings, e.g., openings 304, 306.

One skilled in the art will recognize that any number of different configurations for a spacer for use in a multitude of internal combustion engine applications are possible. For example, the passages defined in one spacer may have different channel configurations. For example, one passage may be defined by a passage surface having V-shaped channels, whereas another passage may be defined by a passage surface including square or rectangular-type channels. Further, for example, the channels of a single passage may have different defining structures, e.g., one channel may be V-shaped and another channel of the same passage may be U-shaped.

Likewise, it will be readily apparent to one skilled in the art that one spacer may include passages of different sizes. For example, the rear barrels may have spacer passages associated therewith which are of a different size than the spacer passages associated with the front barrels.

Figure 12:
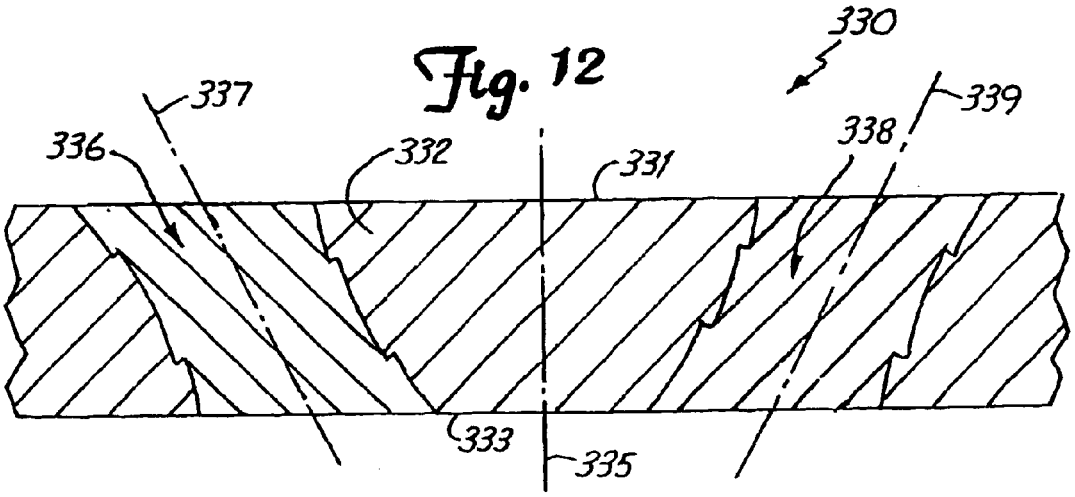
FIG. 12 is a cross-section view through two passages of an alternate spacer portion wherein each passage lies along an axis that is at an angle relative to a plane orthogonal to the spacer portion.

Further, as shown in FIG. 12, passages 336, 338 may be defined in a spacer body 332 of a spacer portion 330 at an angle as opposed to vertical within the spacer body 332. As shown therein, passage 336 extends along axis 337 which lies at an angle to a plane 335 orthogonal to the upper and lower surfaces 331, 333 of the spacer body 332. Likewise, passage 338 extends along axis 339. Axis 339 lies at an angle relative to the orthogonal plane 335. In the configuration of FIG. 12, the passages 336 and 338 are positioned for flow of air-fuel mixture towards one another. One skilled in the art will recognize that flows in opposing directions may also be implemented.

Figure 13A:
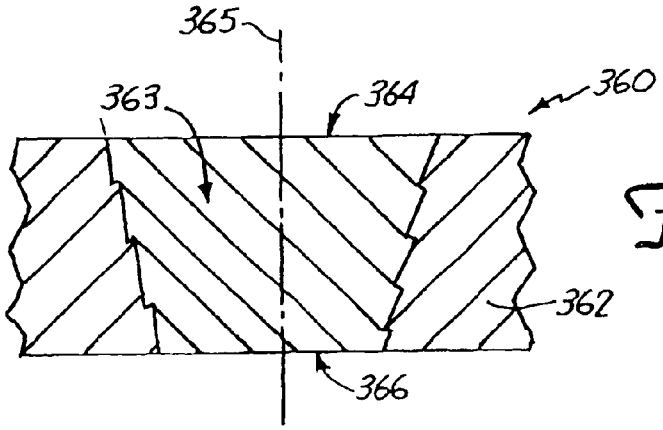
FIGS. 13A and 13B show cross-section views through passages of alternate spacer portions wherein the passages have upper and lower openings of different sizes.
Figure 13B:
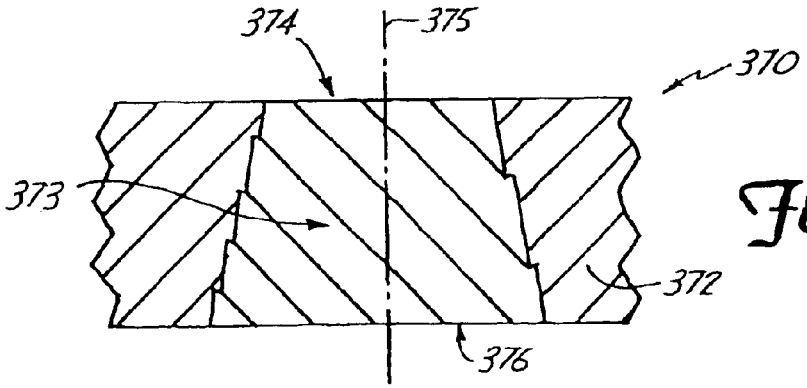

As shown in FIG. 13A, a passage 363 is defined in a spacer portion 360. The passage 363 is defined from an inlet opening 364 in spacer body 362 to an outlet opening 366 of spacer body 362 along axis 365. The opening 364 is of a size that is larger than the outlet opening 366. Likewise, as shown in FIG. 13B, spacer body 372 of spacer portion 370 may include an inlet opening 374 that is slightly smaller than an outlet opening 376 of a passage 373 defined along axis 375.

The preceding specific embodiments are illustrative of the practice of the invention. It is to be understood, therefore, that other expedients known to those skilled in the art or disclosed herein may be employed without departing from the invention or the scope of the appended claims. For example, a device according to the present invention may include or incorporate any number of the illustrative configurations as described herein. For example, a spacer may include a passage formed as a venturi and include V-shaped channels, whereas another passage of the spacer may be formed as a venturi without any channels at all. Further, for example, any number of passages through a spacer may be used for a particular desired application, e.g., single-barrel carburetor, two-barrel carburetor, or four-barrel carburetor. As such, the present invention includes within its scope other methods of implementing and using the invention described herein above.

What is claimed is:

1. A device for use with an internal combustion engine, the device comprising:

an insert body portion sized to be received within an opening defined in an intake path of an internal combustion engine; and at least one passage surface defining at least one passage about an axis through the insert body portion, wherein the at least one passage surface defines at least one channel.

2. The device of claim 1, wherein at least a portion of the at least one channel is at an angle relative to the axis of the passage.

3. The device of claim 1, wherein the at least one passage surface defines a plurality of channels, and further wherein each of the plurality of channels is at an angle relative to the axis of the passage.

4. The device of claim 3, wherein one or more of the plurality of channels is defined by a first channel surface and a second channel surface sharing an edge thereof with the first channel surface.

5. The device of claim 1, wherein the at least one passage surface defines a plurality of channels continuously about an inner circumference of the passage, and further wherein at least a portion of each channel is at an angle relative to the axis of the passage.

6. The device of claim 1, wherein the at least one channel is defined by a single channel surface, and further wherein the single channel surface has a curved portion with a predetermined radius of curvature.

7. The device of claim 1, wherein the at least one channel is defined by a first channel surface and a second channel surface.

8. The device of claim 7, wherein at least one of the first channel surface and the second channel surface is a substantially planar surface.

9. The device of claim 7, wherein as least one of the first channel surface and second channel surface is a curved surface.

10. The device of claim 1, wherein the at least one channel is defined by a plurality of channel surfaces.

11. The device of claim 10, wherein the plurality of channel surfaces form one of a substantially V-type channel or a substantially rectangular-type channel.

12. The device of claim 1, wherein the at least one channel is defined by a first channel surface and a second channel surface, wherein at least one of the first channel surface and the second channel surface is a curved surface having a radius of curvature, and further wherein the center of the radius of curvature is outside of the passage.

13. The device of claim 1, wherein the at least one channel is defined by a first channel surface and a second channel surface, wherein at least one of the first channel surface and the second channel surface is a curved surface having a radius of curvature, and further wherein the center of the radius of curvature is on the same side relative to the curved surface as the axis of the passage.

14. The device of claim 1, wherein at least a portion of the at least one passage surface defining the passage is a surface that forms at least a part of a venturi, wherein the at least one channel is defined by the at least a portion of the at least one passage surface.

15. The device of claim 14, wherein the continuous surface is closest to the axis of the passage at a position substantially equidistant between the first opening region and the second opening region of the passage surface.

16. A device for use with an internal combustion engine, the device comprising:

an insert body portion sized to be received within an opening defined in an intake path of an internal combustion engine; and at least one passage surface defining at least one passage about an axis through the insert body portion, wherein at least a portion of the passage surface defining the passage is a surface that extends between a first opening region of the passage inward towards the axis of the passage and then further extends away from the axis of the passage towards a second opening region of the passage, and further wherein the at least a portion of the at least one passage surface defines at least one channel.

17. The device of claim 16, wherein at least a portion of the at least one channel is at an angle relative to the axis of the passage.

18. The device of claim 16, wherein the at least one passage surface defines a plurality of channels, and further wherein each of the plurality of channels is at an angle relative to the axis of the passage.

19. The device of claim 16, wherein the at least one passage surface defines a plurality of channels continuously about an inner circumference of the passage, and further wherein at least a portion of each channel is at an angle relative to the axis of the passage.

20. A device for use with an internal combustion engine, the device comprising:

a body portion; and at least one passage surface defining at least one passage about an axis through the body portion, wherein the at least one passage surface defines at least one channel extending from a first end region to a second end region, and further wherein the at least one passage surface comprises a tapered surface from the first end region to the second end region.

21. The device of claim 20, wherein at least a portion of the at least one channel is at an angle relative to the axis of the passage.

22. The device of claim 20, wherein the body portion defines a first opening of the passage proximate the first end region and a second opening of the passage proximate the second end region, and further wherein the first and second openings are of a different size.

23. The device of claim 20, wherein the at least one passage surface defines a plurality of channels, and further wherein each of the plurality of channels is at an angle relative to the axis of the passage.

24. The device of claim 23, wherein one or more of the plurality of channels is defined by a first channel surface and a second channel surface sharing an edge thereof with the first channel surface.

25. The device of claim 20, wherein the at least one passage surface defines a plurality of channels continuously about an inner circumference of the passage, and further wherein at least a portion of each channel is at an angle relative to the axis of the passage.

26. The device of claim 20, wherein the body portion is an insert body portion sized to be positioned within an opening of another device body.

27. A device for use with an internal combustion engine, the device comprising:

a body portion; and at least one passage surface defining at least one passage about an axis through the body portion, wherein the passage has an inner circumference, wherein the passage surface defines a plurality of channels continuously about the inner circumference of the passage.

28. The device of claim 27, wherein one or more of the plurality of channels is defined by a single channel surface, and further wherein the single channel surface has a curved portion with a predetermined radius of curvature.

29. The device of claim 27, wherein one or more of the plurality or channels is defined by a first channel surface and a second channel surface.

30. The device of claim 29, wherein at least one of the first channel surface and the second channel surface is a substantially planar surface.

31. The device of claim 29, wherein at least one of the first channel surface and second channel surface is a curved surface.

32. The device of claim 27, wherein one or more of the plurality of channels is defined by a plurality of channel surfaces.

33. The device of claim 32, wherein the plurality of channel surfaces form one of a substantially V-type channel or a substantially rectangular-type channel.

34. A device for use with an internal combustion engine, the device comprising:

a body portion; and at least one passage surface defining at least one passage about an axis through the body portion, wherein the passage surface defines a plurality of channels about the axis, wherein one or more of the plurality of channels extend along a length of the passage and are defined by one or more channel surfaces, and further wherein at least one of the one or more channel surfaces is at a predetermined angle relative to the axis along the entire length.

35. The device of claim 34, wherein one or more of the plurality of channels is defined by a single channel surface extending from a first region of the passage to a second region of the passage along the length, and further wherein the single channel surface has a curved portion with a predetermined radius of curvature.

36. The device of claim 34, wherein one or more of the plurality of channels is defined by a first channel surface and a second channel surface.

37. The device of claim 36, wherein at least one of the first channel surface and the second channel surface is a substantially planar surface.

38. The device of claim 36, wherein at least one of the first channel surface and second channel surface is a curved surface.

39. The device of claim 34, wherein one or more of the plurality of channels is defined by a plurality of channel surfaces.

40. The device of claim 39, wherein the plurality of channel surfaces form one of a substantially V-type channel or a substantially rectangular-type channel.

41. The device of claim 34, wherein the passage has an inner circumference, and further wherein the plurality of channels are defined continuously about the inner circumference of the passage.

42. A device for use with an internal combustion engine, the device comprising:

a body portion; and at least one passage surface defining at least one passage about an axis through the body portion, wherein at least a portion of the at least one passage surface defining the at least one passage forms a venturi, and further wherein the at least a portion of the at least one passage surface defines a plurality of channels.

43. The device of claim 42, wherein at least a portion of at least one channel of the plurality of channels is at an angle relative to the axis.

44. The device of claim 42, wherein the at least one passage surface defines a plurality of channels continuously about an inner circumference of the passage.

45. The device of claim 44, wherein at least a portion of each channel is at an angle relative to the axis of the passage.

46. The device of claim 42, wherein the body portion defines a first opening of the passage proximate a first region of the passage and a second opening of the passage proximate a second region of the passage, and further wherein the first and second openings are of a different size.

47. The device of claim 42, wherein one or more of the plurality of channels is defined by a first channel surface and a second channel surface sharing an edge thereof with the first channel surface.

48. The device of claim 42, wherein the body portion is an insert body portion sized to be positioned within an opening of another device body.

49. The device of claim 42, wherein one or more of the plurality of channels is defined by a single channel surface, and further wherein the single channel surface has a curved portion with a predetermined radius of curvature.

50. The device of claim 42, wherein one or more of the plurality of channels is defined by a first channel surface and a second channel surface.

51. The device of claim 50, wherein at least one of the first channel surface and the second channel surface is a substantially planar surface.

52. The device of claim 50, wherein at least one of the first channel surface and second channel surface is a curved surface.

53. The device of claim 42, wherein one or more of the plurality of channels is defined by a plurality of channel surfaces.

54. The device of claim 53, wherein the plurality of channel surfaces form one of a substantially V-type channel or a substantially rectangular-type channel.

* * * * *